US011780243B2

(12) United States Patent
Uezawa et al.

(10) Patent No.: US 11,780,243 B2
(45) Date of Patent: Oct. 10, 2023

(54) LIQUID EJECTING HEAD AND LIQUID EJECTING APPARATUS

(71) Applicant: SEIKO EPSON CORPORATION, Tokyo (JP)

(72) Inventors: Haruhisa Uezawa, Shiojiri (JP); Hiroki Kobayashi, Matsumoto (JP); Katsuhiro Okubo, Azumino (JP); Kentaro Murakami, Matsumoto (JP); Takahiro Kanegae, Shiojiri (JP); Shingo Tomimatsu, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/663,796

(22) Filed: May 17, 2022

(65) Prior Publication Data

US 2022/0371338 A1 Nov. 24, 2022

(30) Foreign Application Priority Data

May 18, 2021 (JP) ..... 2021-083738

(51) Int. Cl.
*B41J 11/00* (2006.01)

(52) U.S. Cl.
CPC ..... *B41J 11/0024* (2021.01)

(58) Field of Classification Search
CPC ..... B41J 11/0024; B41J 2002/14419; B41J 2202/08; B41J 2/14233; B41J 2202/19; B41J 2202/20; B41J 2/14201; B41J 2/14
See application file for complete search history.

(56) References Cited

U.S. PATENT DOCUMENTS

2022/0126521 A1* 4/2022 Hashimoto ..... B29C 64/209

FOREIGN PATENT DOCUMENTS

JP 2010-143109 A 7/2010

* cited by examiner

*Primary Examiner* — Bradley W Thies
(74) *Attorney, Agent, or Firm* — WORKMAN NYDEGGER

(57) ABSTRACT

A liquid ejecting head includes: a plurality of head chips having nozzles; a holder holding the plurality of head chips; and a planar heater disposed on the holder and heating the holder, in which the heater includes an outer peripheral region along an outer edge of the holder and a middle region positioned inside the outer peripheral region in a plan view, and a heat generation amount per unit time of the outer peripheral region is larger than a heat generation amount per unit time of the middle region.

12 Claims, 16 Drawing Sheets

LIQUID EJECTING HEAD AND LIQUID EJECTING APPARATUS

The present application is based on, and claims priority from JP Application Serial Number 2021-083738, filed May 18, 2021, the disclosure of which is hereby incorporated by reference herein in its entirety.

BACKGROUND

1. Technical Field

The present disclosure relates to a liquid ejecting head and a liquid ejecting apparatus.

2. Related Art

In general, a liquid ejecting apparatus such as an ink jet printer is provided with a liquid ejecting head ejecting a liquid such as ink as droplets. The liquid ejecting head may be provided with a heater heating a liquid as in, for example, the ink jet head described in JP-A-2010-143109.

JP-A-2010-143109 does not disclose the distribution of the heat generation amount per unit time of the heater. Here, it is desired to efficiently heat a liquid with a heater and without waste.

SUMMARY

According to an aspect of the present disclosure, a liquid ejecting head includes: a plurality of head chips having a plurality of liquid ejecting nozzles; a holder holding the plurality of head chips; and a planar heater disposed on the holder and heating the holder, in which the heater includes an outer peripheral region along an outer edge of the holder and a middle region positioned inside the outer peripheral region in a plan view, and a heat generation amount per unit time of the outer peripheral region is larger than a heat generation amount per unit time of the middle region.

According to another aspect of the present disclosure, a liquid ejecting head includes: the liquid ejecting head of the above aspect; and a control portion controlling drive of the heater.

DESCRIPTION OF EXEMPLARY EMBODIMENTS

Figure 1:
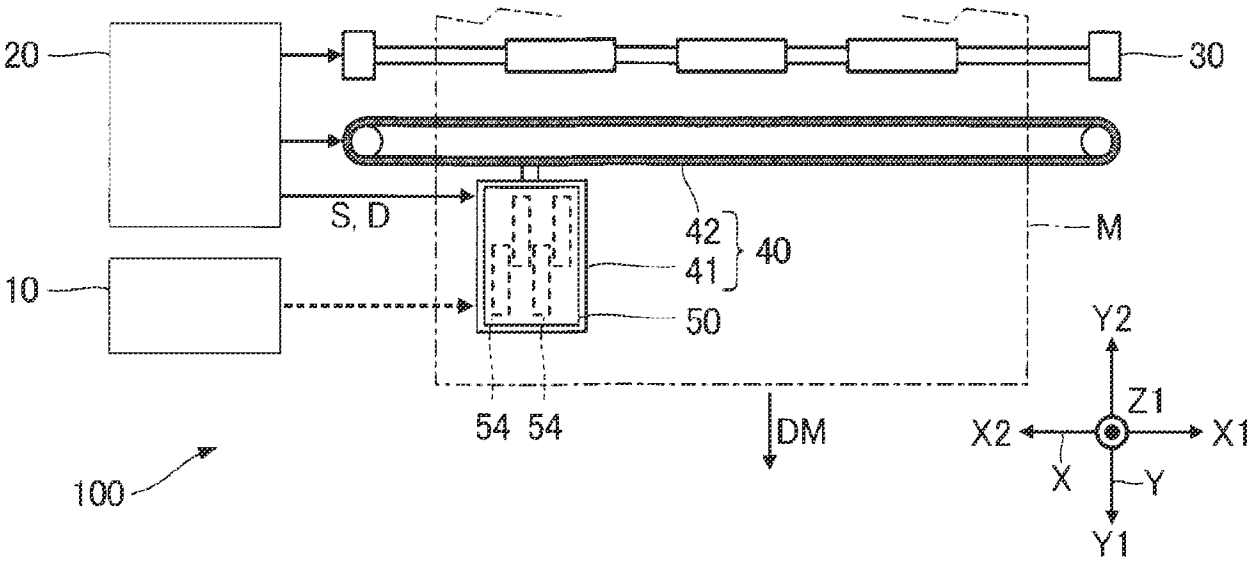
FIG. 1 is a schematic view illustrating a configuration example of a liquid ejecting apparatus according to a first embodiment.

Hereinafter, preferred embodiments according to the present disclosure will be described with reference to the accompanying drawings. In the drawings, the dimensions and scale of each portion are appropriately different from the actual ones and some parts are schematically illustrated for easy understanding. In addition, the scope of the present disclosure is not limited to these forms unless it is stated in the following description that the present disclosure is particularly limited.

In the following description, mutually intersecting X, Y, and Z axes are appropriately used for convenience. In addition, in the following description, one direction along the X axis is an X1 direction and the direction opposite to the X1 direction is an X2 direction. Likewise, Y1 and Y2 directions are opposite to each other along the Y axis. In addition, Z1 and Z2 directions are opposite to each other along the Z axis. In addition, viewing in the Z axis direction may be simply referred to as "plan view". The Y1 or Y2 direction is an example of "first direction". The X1 or X2 direction is an example of "second direction".

Here, typically, the Z axis is a vertical axis and the Z2 direction corresponds to the downward direction in the vertical direction. However, the Z axis may not be vertical. Although the X, Y, and Z axes are typically orthogonal to each other, the axes are not limited thereto and may intersect at an angle of, for example, 80° or more and 100° or less.

1. FIRST EMBODIMENT

1-1. Schematic Configuration of Liquid Ejecting Apparatus

FIG. 1 is a schematic view illustrating a configuration example of a liquid ejecting apparatus 100 according to a first embodiment. The liquid ejecting apparatus 100 is an ink jet printing apparatus ejecting ink, which is an example of "liquid", as droplets onto a medium M. The medium M is typically printing paper. The medium M is not limited to printing paper and may be an object of printing of any material such as a resin film and a cloth.

As illustrated in FIG. 1, the liquid ejecting apparatus 100 has a liquid storage portion 10, a control unit 20, a transport mechanism 30, a moving mechanism 40, and a liquid ejecting head 50.

The liquid storage portion 10 is an ink storage container. Examples of a specific aspect of the liquid storage portion 10 include a cartridge that can be attached to and detached from the liquid ejecting apparatus 100, a bag-shaped ink pack formed of a flexible film, and a container such as an ink-replenishable ink tank.

The liquid storage portion 10 has a plurality of containers (not illustrated) where different types of inks are stored. The inks stored in the containers are not particularly limited, examples thereof include cyan ink, magenta ink, yellow ink, black ink, clear ink, white ink, and a treatment liquid, and combinations of two or more of these are used. The composition of the ink is not particularly limited, and the ink may be, for example, a water-based ink in which a coloring material such as a dye and a pigment is dissolved in a water-based solvent, a solvent-based ink in which a coloring material is dissolved in an organic solvent, or an ultraviolet-curable ink.

Exemplified in the present embodiment is a configuration in which four different types of inks are used. The inks have different colors such as cyan, magenta, yellow, and black.

The control unit 20 controls the operation of each element of the liquid ejecting apparatus 100. For example, the control unit 20 includes a processing circuit such as a central processing unit (CPU) and a field programmable gate array (FPGA) and a storage circuit such as a semiconductor memory. The control unit 20 outputs a drive signal D and a control signal S toward the liquid ejecting head 50. The drive signal D includes a drive pulse driving the drive element of the liquid ejecting head 50. The control signal S specifies whether or not to supply the drive signal D to the drive element. In addition, the control unit 20 is an example of "control portion" and controls the drive of a heater 56, which will be described later.

The transport mechanism 30 transports the medium M in a transport direction DM, which is the Y1 direction, under the control of the control unit 20. The moving mechanism 40 reciprocates the liquid ejecting head 50 in the X1 and X2 directions under the control of the control unit 20. In the example illustrated in FIG. 1, the moving mechanism 40 has a substantially box-shaped support body 41 called a carriage and accommodating the liquid ejecting head 50 and a transport belt 42 to which the support body 41 is fixed. The support body 41 supports the liquid ejecting head 50 and is made of a metal material. The liquid storage portion 10 as well as the liquid ejecting head 50 may be mounted in the support body 41.

The liquid ejecting head 50 has a plurality of head chips 54. Under the control of the control unit 20, the liquid ejecting head 50 ejects the ink supplied from the liquid storage portion 10 from each of a plurality of nozzles of the head chips 54 toward the medium M in the Z2 direction. This ejection is performed in parallel with the transport of the medium M by the transport mechanism 30 and the reciprocating movement of the liquid ejecting head 50 by the moving mechanism 40. As a result, a predetermined ink-based image is formed on the surface of the medium M.

The liquid storage portion 10 may be coupled to the liquid ejecting head 50 via a circulation mechanism. The circulation mechanism supplies ink to the liquid ejecting head 50 and collects the ink discharged from the liquid ejecting head 50 for resupply to the liquid ejecting head 50. As a result of the operation of the circulation mechanism, an increase in ink viscosity can be suppressed and air bubble retention in ink can be reduced.

1-2. State of Liquid Ejecting Head Attachment

Figure 2:
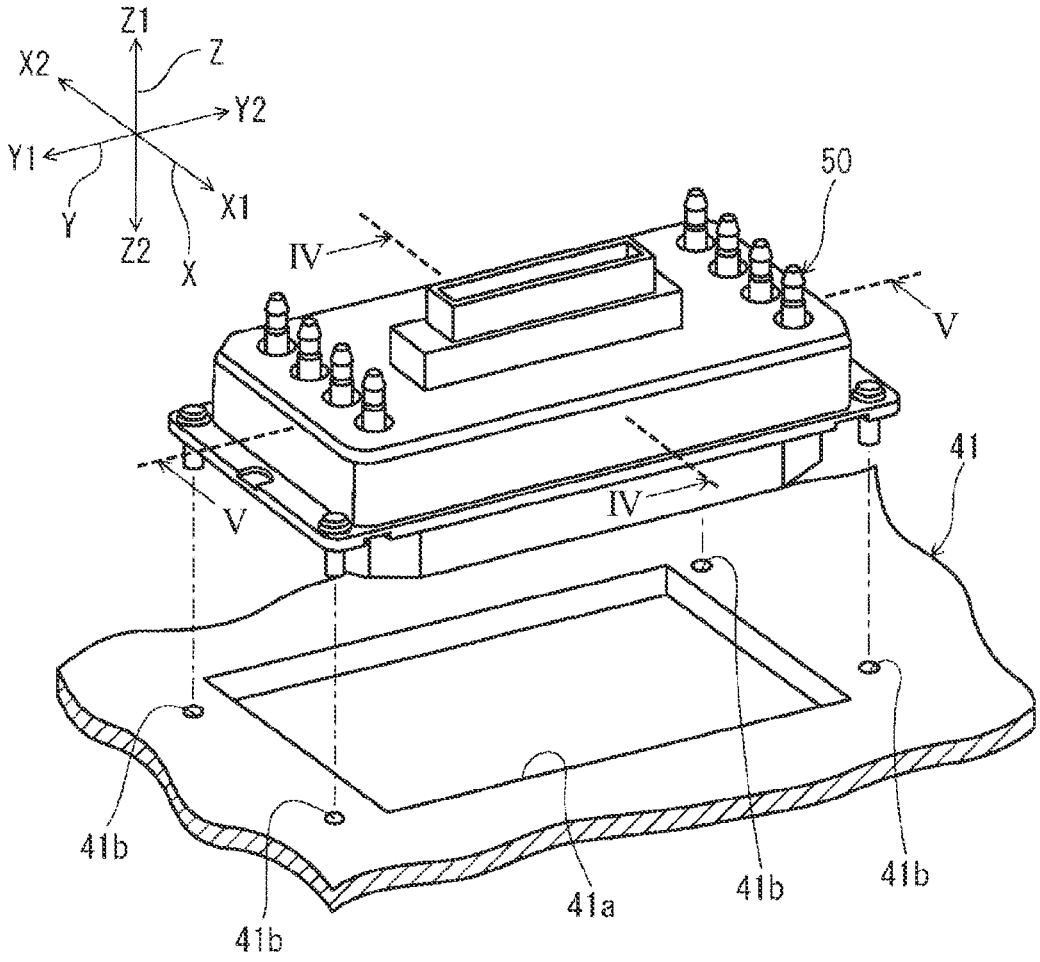
FIG. 2 is a perspective view of a liquid ejecting head and a support body according to the first embodiment.

FIG. 2 is a perspective view of the liquid ejecting head 50 and the support body 41 according to the first embodiment. As illustrated in FIG. 2, the liquid ejecting head 50 is supported by the support body 41. The support body 41 is a member supporting the liquid ejecting head 50. In the present embodiment, the support body 41 is a substantially box-shaped carriage as described above. The constituent material of the support body 41 is not particularly limited, and preferable examples thereof include a metal material such as stainless steel, aluminum, titanium, and a magnesium alloy. When the support body 41 is made of a metal material, the rigidity of the support body 41 can be enhanced with ease, and thus the liquid ejecting head 50 can be stably supported with respect to the support body 41. In addition, the support body 41 is conductive in this case, and thus a reference potential can be supplied to the liquid ejecting head 50 via the support body 41.

Here, the support body 41 is provided with an opening 41*a* and a plurality of screw holes 41*b*. In the present embodiment, the support body 41 has a substantially box shape having a plate-shaped bottom portion and the opening 41*a* and the screw holes 41*b* are provided in, for example, the bottom portion. The liquid ejecting head 50 is fixed to the support body 41 by screwing using the screw holes 41*b* with the liquid ejecting head 50 inserted in the opening 41*a*. As described above, the liquid ejecting head 50 is attached with respect to the support body 41.

In the example illustrated in FIG. 2, the liquid ejecting head 50 that is attached to the support body 41 is one in number. The liquid ejecting head 50 that is attached to the support body 41 may be two or more in number. In this case, the support body 41 is appropriately provided with, for example, the opening 41*a* that corresponds in number or shape to the number.

1-3. Configuration of Liquid Ejecting Head

Figure 3:
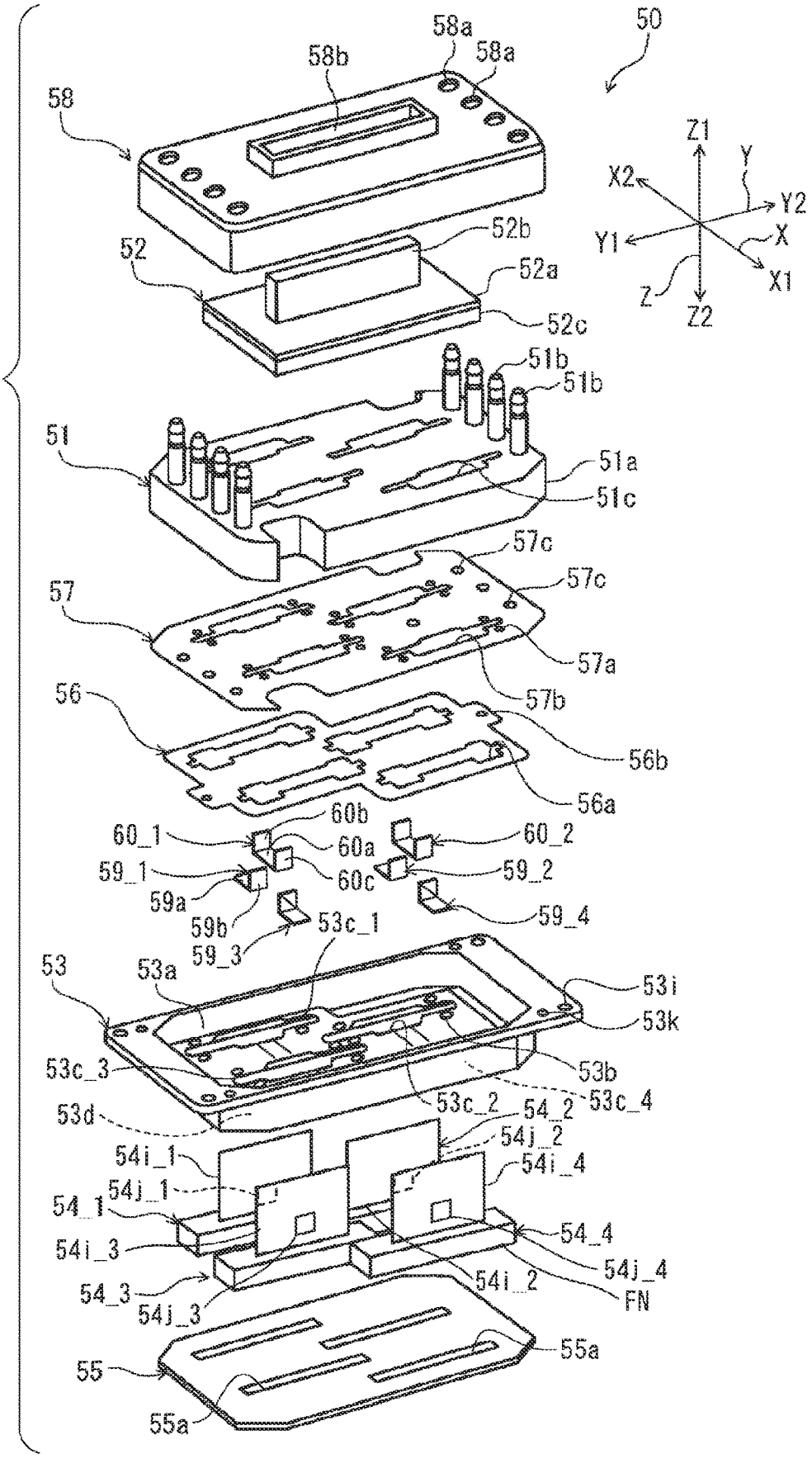
FIG. 3 is an exploded perspective view of the liquid ejecting head according to the first embodiment.
Figure 4:
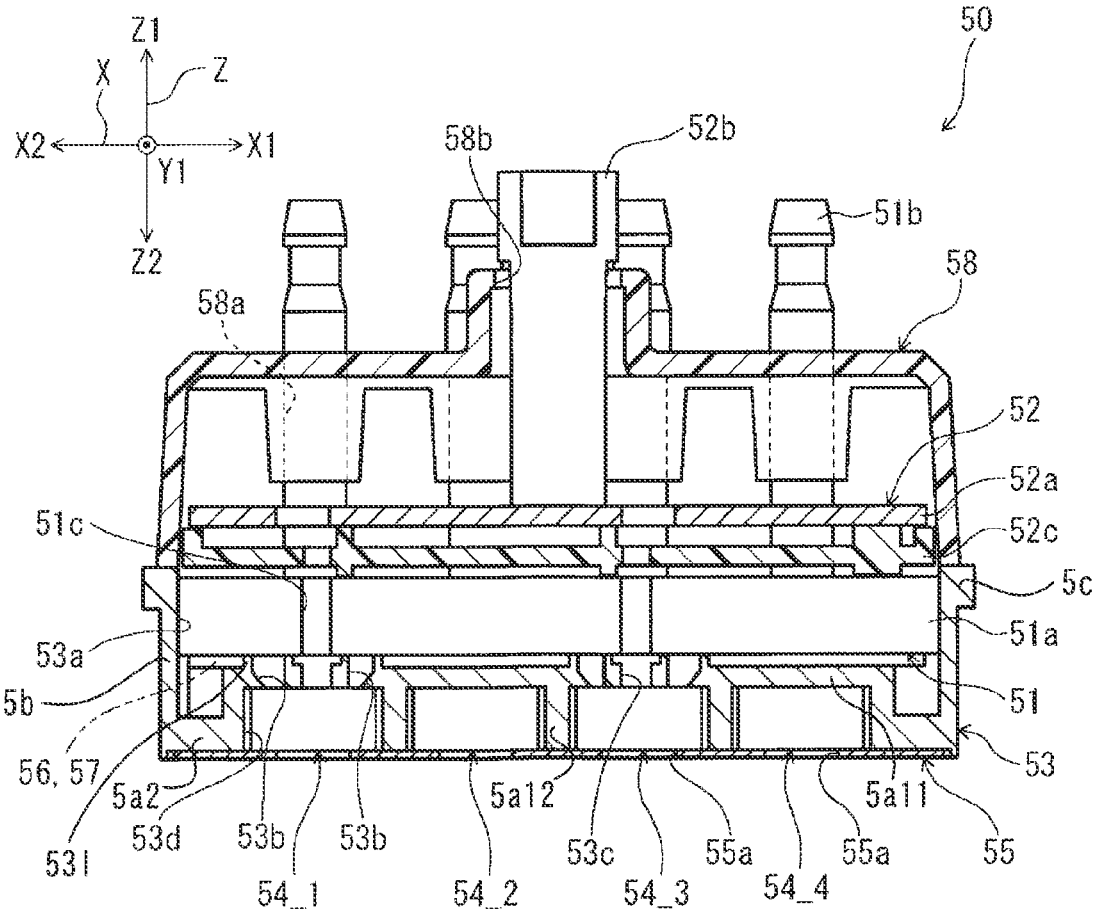
FIG. 4 is a cross-sectional view taken along line IV-IV in FIG. 2.
Figure 5:
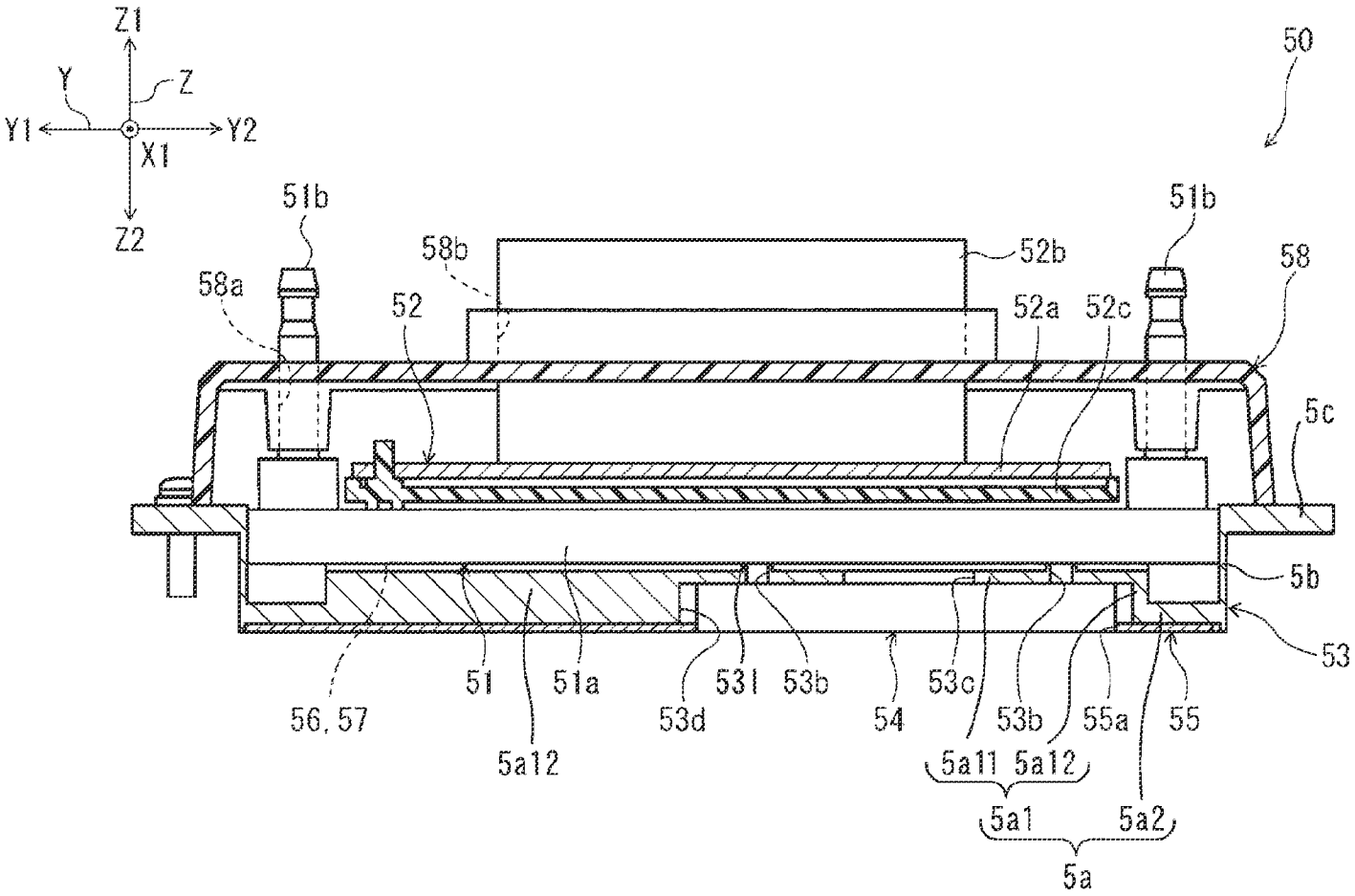
FIG. 5 is a cross-sectional view taken along line V-V in FIG. 2.

FIG. 3 is an exploded perspective view of the liquid ejecting head 50 according to the first embodiment. FIG. 4 is a cross-sectional view taken along line IV-IV in FIG. 2. FIG. 5 is a cross-sectional view taken along line V-V in FIG. 2. For convenience, each portion of the liquid ejecting head 50 in FIGS. 3 to 5 is briefly illustrated as appropriate. For example, although a gap is provided between an outer wall portion 5*b* and a flow path structure 51 to be described later, the gap is not illustrated in FIGS. 4 and 5 and this non-illustration is for convenience of drawing. In addition, the illustration of the heater 56 and a heat transfer member 57 to be described later is simplified in FIGS. 4 and 5.

As illustrated in FIG. 3, the liquid ejecting head 50 has the flow path structure 51, a substrate unit 52, a holder 53, four head chips 54_1 to 54_4, a fixing plate 55, the heater 56, the heat transfer member 57, a cover 58, four pressing members 59_1 to 59_4, and two heat dissipation members 60_1 and 60_2.

The cover 58, the substrate unit 52, the flow path structure 51, the heat transfer member 57, the heater 56, the holder 53, the four head chips 54_1 to 54_4, and the fixing plate 55 are disposed in this order so as to be arranged toward the Z2 direction. Here, the four pressing members 59_1 to 59_4 and the two heat dissipation members 60_1 and 60_2 are disposed on the surface of the holder 53 facing the Z1 direction. Hereinafter, each portion of the liquid ejecting head 50 will be described in sequence.

Provided in the flow path structure 51 is a flow path for supplying the ink stored in the liquid storage portion 10 to the four head chips 54. The flow path structure 51 has a flow path member 51*a* and eight coupling pipes 51*b*.

The flow path member 51*a* is provided with four supply flow paths (not illustrated) provided for each of the four types of inks and four discharge flow paths (not illustrated) provided for each of the four types of inks. Each of the four supply flow paths has one introduction port where ink is supplied and two discharge ports where ink is discharged. Each of the four discharge flow paths has two introduction ports where ink is supplied and one discharge port where ink is discharged. Each of the introduction ports of the supply flow paths and the discharge ports of the discharge flow paths is provided on the surface of the flow path member 51*a* that faces the Z1 direction. On the other hand, each of the discharge ports of the supply flow paths and the introduction ports of the discharge flow paths is provided on the surface of the flow path member 51*a* that faces the Z2 direction.

In addition, the flow path member 51*a* is provided with a plurality of wiring holes 51*c*. A wiring substrate 54*i* (described later) of the head chip 54 is passed through each of the wiring holes 51*c* toward the substrate unit 52. As for the side surface of the flow path member 51*a*, notched parts are provided at two points in the circumferential direction. Disposed in the space resulting from the part is, for example, a component such as wiring (not illustrated) coupling the heater 56 and the substrate unit 52. In addition, the flow path member 51*a* is provided with a hole (not illustrated) and fixing with respect to the holder 53 is performed by screwing using the hole.

The flow path member 51*a* is configured by a laminate (not illustrated) in which a plurality of substrates are laminated in the direction along the Z axis. The respective substrates are appropriately provided with grooves and holes for the supply and discharge flow paths described above. The substrates are mutually joined by means of, for example, an adhesive, brazing, welding, or screwing. If necessary, a sheet-shaped seal member made of a rubber material or the like may be appropriately disposed between the substrates. In addition, the number, thickness, and so on of the substrates that constitute the flow path member 51*a* are determined in accordance with an aspect such as the shapes of the supply and discharge flow paths and are any not particularly limited.

It is preferable that a material that is satisfactory in terms of thermal conductivity is used as the constituent material of each of the substrates, and preferable examples thereof include a metal material (e.g. stainless steel, titanium, and magnesium alloy) and a ceramics material (e.g. silicon carbide, aluminum nitride, sapphire, alumina, silicon nitride, cermet, and yttria) having a thermal conductivity of 10.0 W/m·K or more at room temperature (20 degrees Celsius). By configuring the flow path member 51*a* using such a metal or ceramics material, the ink in the flow path member 51*a* can be efficiently heated by the heat from the heater 56.

Each of the eight coupling pipes 51*b* is a pipe body protruding from the surface of the flow path member 51*a* that faces the Z1 direction. The eight coupling pipes 51*b* correspond to the four supply flow paths and the four discharge flow paths described above and are coupled to the introduction ports of the supply flow paths or the discharge ports of the discharge flow paths that correspond. Although the constituent material of each coupling pipe 51*b* is not particularly limited, it is preferable to use a metal material (e.g. stainless steel, titanium, and magnesium alloy) or a ceramics material (e.g. silicon carbide, aluminum nitride, sapphire, alumina, silicon nitride, cermet, and yttria).

Of the eight coupling pipes 51*b*, the four that correspond to the four supply flow paths described above are coupled to the liquid storage portion 10 so as to receive the supply of different types of inks. Of the eight coupling pipes 51*b*, the four that correspond to the four discharge flow paths are used by being coupled to, for example, a discharge container for discharging ink on a predetermined occasion such as when the liquid ejecting head 50 is initially filled with ink or a sub-tank disposed between the liquid storage portion 10 and the liquid ejecting head 50 and capable of holding a liquid. On normal occasions such as printing, the four coupling pipes 51*b* that correspond to the four discharge flow paths are blocked by a sealing body such as a cap. When the liquid storage portion 10 is coupled to the liquid ejecting head 50 via the circulation mechanism, the four coupling pipes 51*b* that correspond to the four discharge flow paths are normally coupled to the ink collection flow path of the circulation mechanism.

The substrate unit 52 is an assembly having a mounting component for electrically coupling the liquid ejecting head 50 to the control unit 20. The substrate unit 52 has a circuit substrate 52*a*, a connector 52*b*, and a support plate 52*c*.

The circuit substrate 52*a* is a printed wiring substrate such as a rigid wiring substrate having wiring for electrically coupling each head chip 54 and the connector 52*b*. The circuit substrate 52*a* is disposed on the flow path structure 51 via the support plate 52*c*, and the connector 52*b* is installed on the surface of the circuit substrate 52*a* that faces the Z1 direction.

The connector 52*b* is a coupling component for electrically coupling the liquid ejecting head 50 and the control unit 20. The support plate 52*c* is a plate-shaped member for attaching the circuit substrate 52*a* with respect to the flow path structure 51. The circuit substrate 52*a* is mounted on one surface of the support plate 52*c*, and the circuit substrate 52*a* is fixed by screwing or the like with respect to the support plate 52*c*. The other surface of the support plate 52*c* is in contact with the flow path structure 51. The support plate 52*c* is fixed to the flow path structure 51 by screwing or the like in that state.

Here, the support plate 52*c* has not only a function of supporting the circuit substrate 52*a* as described above but also a function of ensuring electrical insulation between the circuit substrate 52*a* and the flow path structure 51 and providing heat insulation between the heater 56 and the circuit substrate 52*a*. From the viewpoint of suitably exhibiting these functions, it is preferable that the constituent material of the support plate 52*c* is a material excellent in terms of electrical and heat insulation. Specifically, it is preferable that the material is, for example, a resin material such as modified polyphenylene ether resin (e.g. Zylon), polyphenylene sulfide resin, and polypropylene resin. Zylon is a registered trademark. In addition, the constituent material of the support plate 52*c* may include a fiber base material (e.g. glass fiber), a filler (e.g. alumina particles), or the like in addition to the resin material.

The holder 53 is a structure accommodating and supporting the four head chips 54. It is preferable that a material that is satisfactory in terms of thermal conductivity is used as the constituent material of the holder 53, and preferable examples thereof include a metal material (e.g. stainless steel, titanium, and magnesium alloy) and a ceramics material (e.g. silicon carbide, aluminum nitride, sapphire, alumina, silicon nitride, cermet, and yttria) having a thermal conductivity of 10.0 W/m·K or more at room temperature (20 degrees Celsius). By configuring the holder 53 using such a metal or ceramics material, the heat from the heater 56 can be efficiently transferred to each head chip 54 via the holder 53.

The holder 53 has a substantially tray shape. In addition, the holder 53 has a rectangular shape or a substantially rectangular shape in a plan view. Here, "substantially rectangular" is a concept including a shape that can be regarded as a substantially rectangular shape and a shape that is similar to a rectangle. The shape that can be regarded as a substantially rectangular shape can be obtained by, for example, performing chamfering such as C chamfering and R chamfering on the four corners of a rectangle. The shape similar to a rectangle is, for example, an octagon including four sides along the rectangle and four sides shorter than each of the four sides.

The holder 53 has a recess 53*a*, a plurality of ink holes 53*b*, a plurality of wiring holes 53*c*, a plurality of recesses 53*d*, a plurality of screw holes 53*i*, and a plurality of screw holes 53*k*. The recess 53*a* is open toward the Z1 direction and is a space where the laminate of the flow path member 51*a*, the heater 56, and the heat transfer member 57 is disposed. Each of the ink holes 53*b* is a flow path allowing ink to flow between the head chip 54 and the flow path structure 51. The wiring substrate 54*i* of the head chip 54 is passed through each of the wiring holes 53*c* toward the substrate unit 52. Each of the recesses 53*d* is open toward the Z2 direction and is a space where the head chip 54 is disposed. The screw holes 53*i* are screw holes for screwing the holder 53 with respect to the support body 41. The screw holes 53*k* are screw holes for screwing the cover 58 with respect to the holder 53. Details of the holder 53 will be described later with reference to FIGS. 7 to 9.

Each of the head chips 54_1 to 54_4 is the head chip 54 illustrated in FIG. 1. In the following description, each of the head chips is referred to as the head chip 54 when the head chips 54_1 to 54_4 are not distinguished. In addition, in the following description, the branch numbers of "_1" to "_4" are appropriately assigned to the reference numerals of the components corresponding to the head chips 54_1 to 54_4, respectively.

Each head chip 54 ejects ink. More specifically, each head chip 54 has a nozzle surface FN. Although not illustrated in FIG. 3, the nozzle surface FN is provided with a plurality of nozzles ejecting a first ink and a plurality of nozzles ejecting a second ink, which is different in type from the first ink. Here, the first and second inks are two of the four types of inks described above. For example, two of the four types of inks are respectively used as the first and second inks for the head chip 54_1 and the head chip 54_2. The other two are respectively used for the head chip 54_3 and the head chip 54_4. Each head chip 54 is provided with the wiring substrate 54*i*. In FIG. 3, the configuration of each head chip 54 is illustrated in a simplified manner. Details of the configuration of the head chip 54 will be described later with reference to FIG. 6.

The fixing plate 55 is a plate-shaped member to which the four head chips 54 and the holder 53 are fixed. Specifically, the fixing plate 55 is disposed with the four head chips 54 sandwiched between the fixing plate 55 and the holder 53 and each head chip 54 and the holder 53 are fixed by means of an adhesive or the like.

The fixing plate 55 is provided with a plurality of opening portions 55*a* exposing the nozzle surface FN of the four head chips 54. In the example illustrated in FIG. 3, the opening portions 55*a* are individually provided for each head chip 54. The fixing plate 55 is made of, for example, a metal material such as stainless steel, titanium, and a magnesium alloy and has a function of transferring heat from the holder 53 to each head chip 54. In addition, the fixing plate 55 is conductive. Accordingly, the fixing plate 55 is grounded via the holder 53 and the support body 41 and also functions as an electrostatic shield for preventing the effect of static electricity from the medium M or the like. The fixing plate 55 may be configured by laminating plate-shaped members made of a metal material.

The opening portion 55*a* may be shared by two or more head chips 54. When the opening portions 55*a* are individually provided for each head chip 54, the area of contact between the fixing plate 55 and each head chip 54 can be increased with ease, and thus heat can be efficiently transferred from the holder 53 to each head chip 54.

The heater 56 is a planar heater disposed between the flow path structure 51 and the holder 53. The heater 56 is, for example, a film heater having a thin film-shaped base material, an insulating film, and a heat-generating resistor sandwiched between the base material and the film. The base material is made of an insulating material and is made of a resin material such as polyimide and polyethylene terephthalate (PET). The film is made of a resin material such as polyimide and polyethylene terephthalate (PET). The heat-generating resistor is a heating wire patterned on the base material and is made of a metal material such as stainless steel, copper, and a nickel alloy. In addition, the heater 56 may be a planar heater such as a ceramic heater and a silicone rubber heater in which a heat-generating resistor is sandwiched between silicone rubber and silicone rubber containing glass fibers. The heat-generating resistor is heat-generating resistors 56*c* and 56*d*, which will be described later.

The heater 56 is provided with a plurality of holes 56*a* and a plurality of holes 56*b*. Each of the holes 56*a* is a hole through which the wiring substrate 54*i* of the head chip 54 and a flow path pipe 53*l* formed in the holder 53 are passed. The ink hole 53*b* formed in the flow path pipe 53*l* is a part of the flow path that allows ink to flow between the head chip 54 and the flow path structure 51. The flow path pipe 53*l* protrudes in the Z1 direction from, for example, the upper surface of the holder 53 facing the Z1 direction (first surface F1 to be described later). The tip of the flow path pipe 53*l* on the Z1 direction side is bonded to the lower surface of the flow path structure 51 facing the Z2 direction. As a result, the ink hole 53*b* is liquid-tightly sealed in relation to the flow path in the flow path structure 51. Each of the holes 56*b* is a hole for screwing the heater 56 with respect to the holder 53.

In particular, the heater 56 is divided into a plurality of regions having different heat generation amounts per unit time in a plan view such that the head chips 54_1 to 54_4 are heated uniformly. The configuration of the heater 56 will be described in detail later with reference to FIGS. 9 to 12.

The heat transfer member 57, which has thermal conductivity, is a plate-shaped member disposed between the flow path structure 51 and the heater 56. The heat transfer member 57 has a function of transferring heat in each of the thickness and plane directions. By means of this function, the heat from the heater 56 is efficiently transferred to the flow path structure 51 via the heat transfer member 57. Here, the heating unevenness of the flow path structure 51 attributable to the local heat generation unevenness of the heater 56 is reduced by means of the plane-direction heat transfer of the heat transfer member 57.

The heat transfer member 57 is made of, for example, a metal material or a thermally conductive material such as ceramics from the viewpoint of suitably exhibiting the above function. Examples of the metal material include stainless steel, aluminum, titanium, and a magnesium alloy. Examples of the ceramics include silicon carbide, aluminum nitride, sapphire, alumina, silicon nitride, cermet, and yttria. The heat transfer member 57 is preferably a material higher in thermal conductivity than the constituent material of the flow path structure 51 or the holder 53.

The heat transfer member 57 is provided with a plurality of holes 57*a*, a plurality of wiring holes 57*b*, and a plurality of holes 57*c*. The flow path pipe 53*l* is inserted through each of the holes 57*a*. The wiring substrate 54*i* of the head chip 54 is passed through each of the wiring holes 57*b* toward the substrate unit 52. The holes 57*c* are holes for screwing the heat transfer member 57 with respect to the holder 53. In the present embodiment, two of the holes 57*c* are used so that the heater 56 and the heat transfer member 57 are fixed to the holder 53 by being tightened together. The heat transfer member 57 may be provided as needed or may be omitted.

The cover 58 is a box-shaped member accommodating the substrate unit 52. The cover 58 is made of, for example, a resin material such as modified polyphenylene ether resin, polyphenylene sulfide resin, and polypropylene resin as in the case of the support plate 52*c* described above.

The cover 58 is provided with eight through holes 58*a* and an opening portion 58*b*. The eight through holes 58*a* correspond to the eight coupling pipes 51*b* of the flow path structure 51, and the corresponding coupling pipe 51*b* is inserted into each through hole 58*a*. The connector 52*b* is passed through the opening portion 58*b* from the inside to the outside of the cover 58.

Each of the heat dissipation members 60_1 and 60_2 is a thermally conductive member for dissipating heat from a drive circuit 54*j* to the holder 53. In the following description, each of the heat dissipation members 60_1 and 60_2 is referred to as a heat dissipation member 60 when the two heat dissipation members 60_1 and 60_2 are not distinguished.

The heat dissipation member 60 thermally couples the drive circuit 54*j* to the flow path structure 51 or the holder 53. In this specification, "thermal coupling" means satisfying any of the following Conditions a, b, and c. Condition a: two members being in direct physical contact. Condition b: two members being disposed via a gap of 100 micrometers or less. Condition c: two members being physically coupled at room temperature (20 degrees Celsius) via another member with a thermal conductivity of 1.0 W/m·K or more. A heat transfer grease, an adhesive, or the like may be present between the two members under each condition. In this case, the adhesive preferably contains a thermally conductive filler or the like from the viewpoint of thermal conductivity enhancement.

The heat dissipation member 60 is made of, for example, a metal material or a thermally conductive material such as ceramics (e.g. silicon carbide, aluminum nitride, sapphire, alumina, silicon nitride, cermet, and yttria). Examples of the metal material include gold, silver, copper, stainless steel, aluminum, titanium, and a magnesium alloy. The heat dissipation member 60 is preferably made of a material higher in thermal conductivity than the flow path structure 51 or the holder 53. By using the heat dissipation member 60 that is high in thermal conductivity, heat dissipation can be efficiently performed on the drive circuit 54*j*.

In the example illustrated in FIG. 3, the heat dissipation member 60 has the shape of a plate bent in a U shape and has a part 60*a*, a part 60*b*, and a part 60*c*. The part 60*a* is disposed between the flow path structure 51 and the holder 53 and is fixed to the holder 53 or the flow path structure 51. The part 60*b* extends along the Z1 direction from the end of the part 60*a* in the X2 direction and is coupled to the drive circuit 54*j*. The part 60*c* extends along the Z1 direction from the end of the part 60*a* in the X1 direction and is coupled to the drive circuit 54*j* different from the part 60*b*. In the present embodiment, the heat dissipation member 60 is fixed to the holder 53 by screwing.

Each of the pressing members 59_1 to 59_4 is an elastic member disposed so as to sandwich the drive circuit 54*j* and the wiring substrate 54*i* (described later) with the heat dissipation member 60 and pressing the drive circuit 54*j* and the wiring substrate 54*i* toward the heat dissipation member 60. In the following description, each of the four pressing members 59_1 to 59_4 is referred to as a pressing member 59 when the four pressing members 59_1 to 59_4 are not distinguished.

With the pressing member 59, which is preferably made of a material excellent in heat insulation, it can be easier to transfer heat from the drive circuit 54*j* to the heat dissipation member 60 than to the pressing member 59.

When the pressing member 59 is made of a material excellent in heat insulation, the material is preferably an elastic material. Specifically, the material has a thermal conductivity of less than 1.0 W/m·K at room temperature (20 degrees Celsius), examples of which include resin materials such as modified polyphenylene ether resin, polyphenylene sulfide resin, and polypropylene resin. By the pressing member 59 being formed of a resin material, the pressing member 59 can be manufactured inexpensively. The pressing member 59 using a resin material as a constituent material can be obtained by, for example, injection molding or the like. The constituent material of the pressing member 59 may contain an inorganic filler such as alumina from the viewpoint of, for example, improving the mechanical strength of the pressing member 59. In addition, from the viewpoint of suitably maintaining a state where the pressing member 59 presses the drive circuit 54*j* or the like, the softening point of the resin material constituting the pressing member 59 is preferably higher than the upper limit temperature of the heater 56.

The pressing member 59 is disposed in a state of being slightly and elastically deformed in a direction away from the heat dissipation member 60. The pressing member 59 presses the drive circuit 54*j* toward the heat dissipation member 60 with the elastic force attributable to this elastic deformation. In the example illustrated in FIG. 3, the pressing member 59 has the shape of a plate bent in an L shape and has a base portion 59*a* and a bent portion 59*b*. The base portion 59*a* is disposed between the flow path structure 51 and the holder 53 and is fixed to the holder 53 or the flow path structure 51. The bent portion 59*b* extends along the Z1 direction from the base portion 59*a* and presses the drive circuit 54*j*. In the present embodiment, the pressing member 59 is fixed to the holder 53 by screwing.

1-4. Configuration of Head Chip

Figure 6:
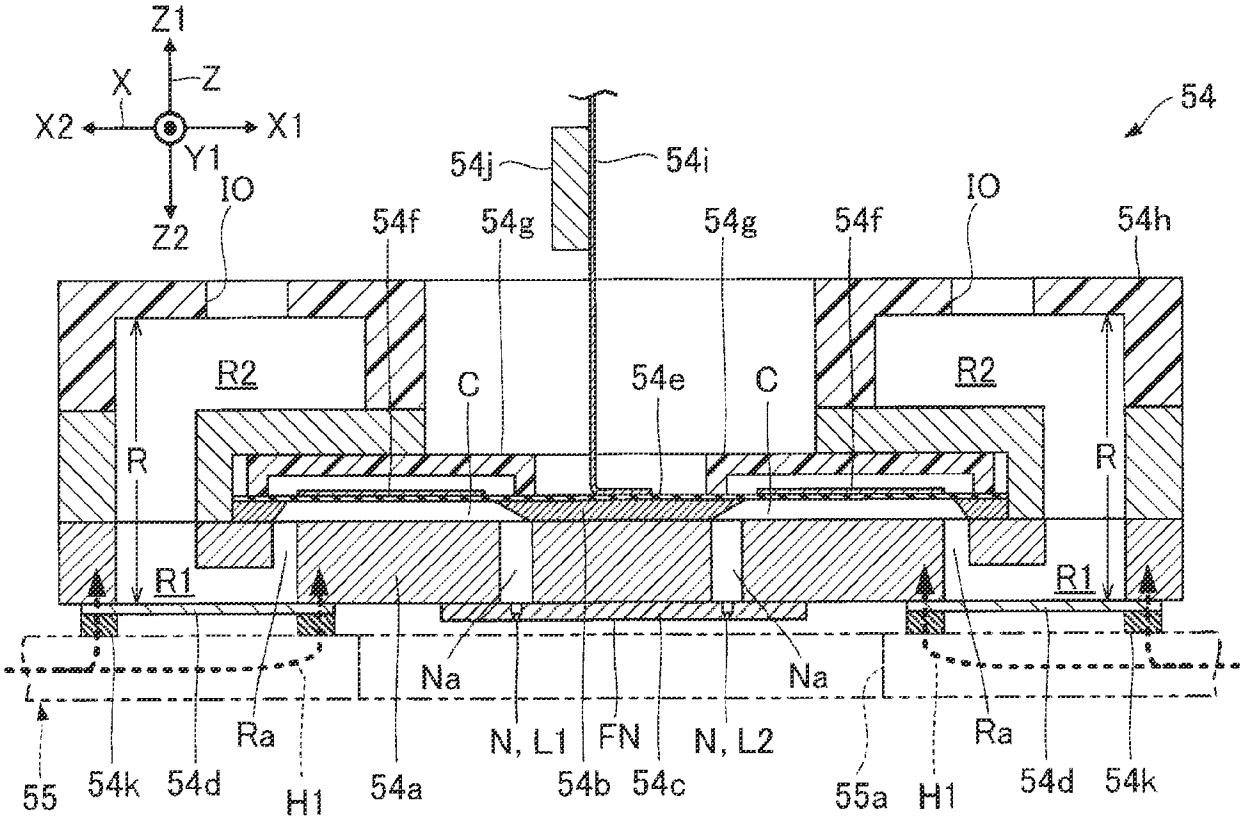
FIG. 6 is a cross-sectional view illustrating an example of a head chip.

FIG. 6 is a cross-sectional view illustrating an example of the head chip 54. As illustrated in FIG. 6, the head chip 54 has a plurality of nozzles N arranged in the direction along the Y axis. The nozzles N are divided into a first row L1 and a second row L2 arranged to be apart from each other in the direction along the X axis. Each of the first row L1 and the second row L2 is a set of the nozzles N arranged in a straight line in the direction along the Y axis.

The head chip 54 has a substantially symmetrical configuration in the direction along the X axis. However, the positions of the nozzles N in the first row L1 and the nozzles N in the second row L2 in the direction along the Y axis may be the same as or different from each other. Exemplified in FIG. 6 is a configuration in which the nozzles N in the first row L1 and the nozzles N in the second row L2 are at the same positions in the direction along the Y axis.

As illustrated in FIG. 6, the head chip 54 has a flow path substrate 54*a*, a pressure chamber substrate 54*b*, a nozzle plate 54*c*, a vibration absorber 54*d*, a diaphragm 54*e*, a plurality of piezoelectric elements 54*f*, a protective plate 54*g*, a case 54*h*, the wiring substrate 54*i*, and a drive circuit 54*j*.

The flow path substrate 54*a* and the pressure chamber substrate 54*b* are laminated in this order in the Z1 direction and form a flow path for ink supply to the nozzles N. The diaphragm 54*e*, the piezoelectric elements 54*f*, the protective plate 54*g*, the case 54*h*, the wiring substrate 54*i*, and the drive circuit 54*j* are installed in the region that is positioned in the Z1 direction beyond the laminate of the flow path substrate 54*a* and the pressure chamber substrate 54*b*. The nozzle plate 54*c* and the vibration absorber 54*d* are installed in the region that is positioned in the Z2 direction beyond the laminate. Schematically, each element of the head chip 54 is a plate-shaped member that is elongated in the Y direction. The elements are joined together by means of, for example, an adhesive. Hereinafter, the elements of the head chip 54 will be described in order.

The nozzle plate 54*c* is a plate-shaped member provided with the respective nozzles N in the first row L1 and the second row L2. Each of the nozzles N is a through hole through which ink is passed. Here, the surface of the nozzle plate 54*c* that faces the Z2 direction is the nozzle surface FN. The nozzle plate 54*c* is manufactured by, for example, processing a silicon single crystal substrate by a semiconductor manufacturing technique using a processing technique such as dry etching and wet etching. Alternatively, another known method and another known material may be appropriately used in manufacturing the nozzle plate 54*c*. The cross-sectional shape of the nozzle is typically circular, the shape is not limited thereto, and the shape may be a non-circular shape such as polygonal and elliptical shapes.

The flow path substrate 54*a* is provided with a space R1, a plurality of supply flow paths Ra, and a plurality of communication flow paths Na for each of the first row L1 and the second row L2. The space R1 is an elongated opening extending in the direction along the Y axis in a plan view in the direction along the Z axis. Each of the supply flow path Ra and the communication flow path Na is a through hole formed for each nozzle N. Each supply flow path Ra communicates with the space R1.

The pressure chamber substrate 54*b* is a plate-shaped member provided with a plurality of pressure chambers C called cavities for each of the first row L1 and the second row L2. The pressure chambers C are arranged in the direction along the Y axis. Each pressure chamber C is an elongated space formed for each nozzle N and extending in the direction along the X axis in a plan view. As in the case of the nozzle plate 54*c* described above, each of the flow path substrate 54*a* and the pressure chamber substrate 54*b* is manufactured by, for example, processing a silicon single crystal substrate by a semiconductor manufacturing technique. Alternatively, another known method and another known material may be appropriately used in manufacturing each of the flow path substrate 54*a* and the pressure chamber substrate 54*b*. The flow path substrate 54*a* is preferably made of a material having a thermal conductivity of 10.0 W/m·K or more and may be made of stainless steel in addition to a silicon single crystal substrate.

The pressure chamber C is a space positioned between the flow path substrate 54*a* and the diaphragm 54*e*. The pressure chambers C are arranged in the direction along the Y axis for each of the first row L1 and the second row L2. In addition, the pressure chamber C communicates with each of the communication flow path Na and the supply flow path Ra. Accordingly, the pressure chamber C communicates with the nozzle N via the communication flow path Na and communicates with the space R1 via the supply flow path Ra.

The diaphragm 54*e* is disposed on the surface of the pressure chamber substrate 54*b* that faces the Z1 direction. The diaphragm 54*e* is a plate-shaped member that is capable of elastically vibrating. The diaphragm 54*e* has, for example, a first layer and a second layer, which are laminated in the Z1 direction in this order. The first layer is, for example, an elastic film made of silicon oxide ($SiO_2$). The elastic film is formed by, for example, thermally oxidizing one surface of a silicon single crystal substrate. The second layer is, for example, an insulating film made of zirconium oxide ($ZrO_2$). The insulating film is formed by, for example, forming a zirconium layer by a sputtering method and thermally oxidizing the layer. The diaphragm 54*e* is not limited to the configuration resulting from the lamination of the first and second layers. For example, the diaphragm 54*e* may be configured by a single layer or three or more layers.

On the surface of the diaphragm 54*e* that faces the Z1 direction, the piezoelectric elements 54*f* mutually corresponding to the nozzles N are disposed as drive elements for each of the first row L1 and the second row L2. Each piezoelectric element 54*f* is a passive element deformed by drive signal supply. Each piezoelectric element 54*f* has an elongated shape extending in the direction along the X axis in a plan view. The piezoelectric elements 54*f* are arranged in the direction along the Y axis so as to correspond to the pressure chambers C. The piezoelectric element 54*f* overlaps the pressure chamber C in a plan view.

Each piezoelectric element 54*f* has a first electrode (not illustrated), a piezoelectric layer (not illustrated), and a second electrode (not illustrated), which are laminated in the Z1 direction in this order. One of the first and second electrodes is an individual electrode disposed so as to be mutually separated for each piezoelectric element 54*f*, and a drive signal is applied to the electrode. The other of the first and second electrodes is a band-shaped common electrode extending in the direction along the Y axis so as to be continuous over the piezoelectric elements 54*f*, and a predetermined reference potential is supplied to the electrode. Examples of the metal material of the electrodes include metal materials such as platinum (Pt), aluminum (Al), nickel (Ni), gold (Au), and copper (Cu). One of the materials can be used alone or two or more can be used in combination in the form of an alloy, lamination, or the like. The piezoelectric layer is made of a piezoelectric material such as lead zirconate titanate (Pb (Zr, Ti) O3). The piezoelectric layer forms, for example, a band shape extending in the direction along the Y axis so as to be continuous over the piezoelectric elements 54*f*. Alternatively, the piezoelectric layer may be integrated over the piezoelectric elements 54*f*. As for the piezoelectric layer in this case, a through hole penetrating the piezoelectric layer is provided, so as to extend in the direction along the X axis, in the region that corresponds in a plan view to the gap between the pressure chambers C adjacent to each other. When the diaphragm 54*e* vibrates in conjunction with the above deformation of the piezoelectric element 54*f*, the pressure in the pressure chamber C fluctuates and ink is ejected from the nozzle N as a result. A heat-generating element heating the ink in the pressure chamber C may replace the piezoelectric element 54*f* as a drive element.

The protective plate 54*g* is a plate-shaped member installed on the surface of the diaphragm 54*e* that faces the Z1 direction, protects the piezoelectric elements 54*f*, and reinforces the mechanical strength of the diaphragm 54*e*. Here, the piezoelectric elements 54*f* are accommodated between the protective plate 54*g* and the diaphragm 54*e*. The protective plate 54*g* is made of, for example, a resin material.

The case 54*h* is a case for storing ink supplied to the pressure chambers C. The case 54*h* is made of, for example, a resin material. The case 54*h* is provided with a space R2 for each of the first row L1 and the second row L2. The space R2 communicates with the space R1 and functions together with the space R1 as a reservoir R storing ink supplied to the pressure chambers C. The case 54*h* is provided with an introduction port IO for ink supply to each reservoir R. The ink in each reservoir R is supplied to the pressure chamber C via each supply flow path Ra.

The vibration absorber 54*d* is also called a compliance substrate, is a flexible resin film constituting the wall surface of the reservoir R, and absorbs the pressure fluctuation of the ink in the reservoir R. The vibration absorber 54*d* may be a metallic and flexible thin plate. The surface of the vibration absorber 54*d* that faces the Z1 direction is joined to the flow path substrate 54*a* by means of, for example, an adhesive. A frame body 54*k* is joined to the surface of the vibration absorber 54*d* that faces the Z2 direction by means of, for example, an adhesive. The frame body 54*k* is a frame-shaped member that is along the outer periphery of the vibration absorber 54*d* and comes into contact with the fixing plate 55. Here, the frame body 54*k* is made of a metal material such as stainless steel, aluminum, titanium, and a magnesium alloy. By configuring the frame body 54*k* by means of a metal material as described above, the heat from the heater 56 can be suitably transferred to the ink in the head chip 54 via the holder 53 and the fixing plate 55.

In FIG. 6, a transfer path H1 of the heat from the heater 56 to the head chip 54 is schematically indicated by a dashed arrow. Although a part of the transfer path H1 includes the vibration absorber 54*d* made of resin, which is a material having a relatively low level of thermal conductivity, the vibration absorber 54*d* is flexible and thus is thin and very small in thermal resistance by being formed in a film shape. Accordingly, the effect of the heat conduction from the frame body 54*k* to the flow path substrate 54*a* being inhibited by the vibration absorber 54*d* is small.

The wiring substrate 54*i*, which is mounted on the surface of the diaphragm 54*e* that faces the Z1 direction, is a mounting component for electrically coupling the control unit 20 and the head chip 54. The wiring substrate 54*i* is a flexible wiring substrate such as a chip on film (COF), a flexible printed circuit (FPC), and a flexible flat cable (FFC). The drive circuit 54*j* for drive voltage supply to each piezoelectric element 54*f* is mounted on the wiring substrate 54*i* of the present embodiment. The drive circuit 54*j* is a circuit including a switching element performing switching based on the control signal S as to whether or not to supply at least a part of the waveform in the drive signal D as a drive pulse to the drive element.

1-5. Configuration of Holder

Figure 7:
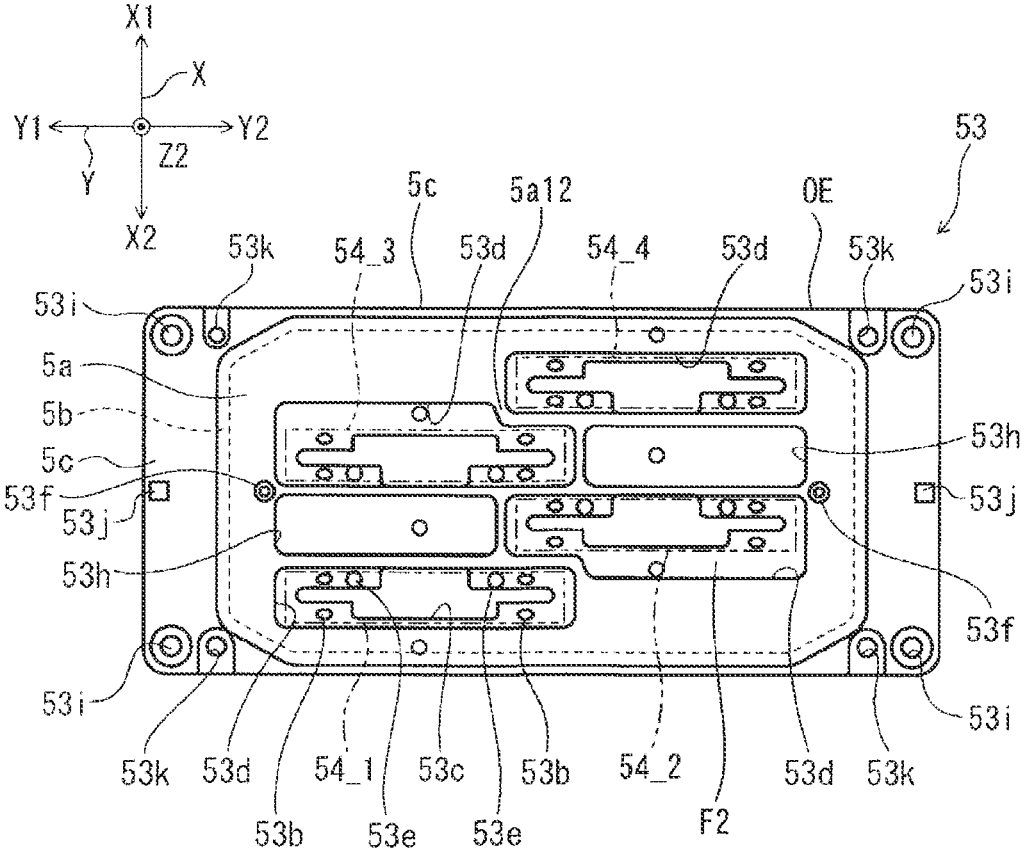
FIG. 7 is a bottom view of a holder in the first embodiment.
Figure 8:
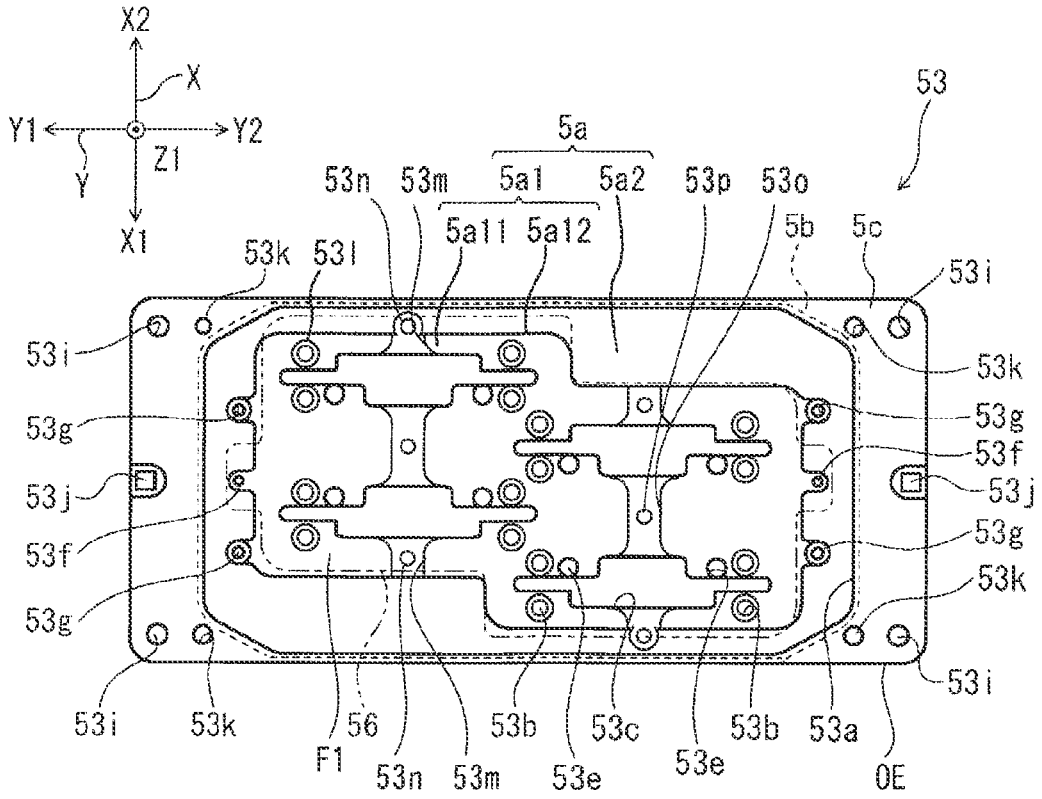
FIG. 8 is a top view of the holder in the first embodiment.

FIG. 7 is a bottom view in which the holder 53 in the first embodiment is viewed in the Z1 direction. FIG. 8 is a top view in which the holder 53 in the first embodiment is viewed in the Z2 direction. As illustrated in FIGS. 7 and 8, the holder 53 having a substantially tray shape as described above has a bottom portion 5*a*, the outer wall portion 5*b*, and a flange portion 5*c*.

The bottom portion 5*a* has a substantially plate shape extending in a direction orthogonal to the Z axis and constitutes the bottom surface of the recess 53*a*. Here, the bottom portion 5*a* is divided into a holding portion 5*a*1 and a coupling portion 5*a*2 disposed so as to surround the outer periphery of the holding portion 5*a*1 and thinner than the holding portion 5*a*1.

The holding portion 5*a*1 has the four recesses 53*d* described above and holds the four head chips 54. Here, each head chip 54 is accommodated in the space that is surrounded by the inner wall surface of each recess 53*d* and the fixing plate 55 described above.

As indicated by the two-dot chain lines in FIG. 7, the head chip 54_1, the head chip 54_2, the head chip 54_3, and the head chip 54_4 are staggered in a plan view. Specifically, the head chip 54_1, the head chip 54_2, the head chip 54_3, and the head chip 54_4 are arranged in this order in the X1 direction. The head chip 54_1 and the head chip 54_3 are disposed at positions misaligned in the Y1 direction with respect to the head chip 54_2 and the head chip 54_4. Here, the head chip 54_1 and the head chip 54_3 are disposed side by side in the direction along the X axis such that the mutual positions in the direction along the Y axis are aligned. Likewise, the head chip 54_2 and the head chip 54_4 are disposed side by side in the direction along the X axis such that the mutual positions in the direction along the Y axis are aligned. In addition, as indicated by the two-dot chain line in FIG. 8, the heater 56 is disposed so as to substantially include the holding portion 5*a*1when viewed in the direction along the Z axis.

In addition, as illustrated in FIG. 7, the holding portion 5*a*1 is provided with two recesses 53*h* in addition to the four recesses 53*d*. Each recess 53*h* is a recess for so-called lightening, disposed between the four recesses 53*d*, and similar in depth to the recess 53*d*. The holding portion 5*a*1 has a heat receiving portion 5*a*11 and a side wall portion 5*a*12.

The heat receiving portion 5*a*11 has a plate shape having the first surface F1 and a second surface F2 extending in a direction orthogonal to the Z axis and constitutes the bottom surfaces of the recess 53*d* and the recess 53*h*. The first surface F1, which faces the Z1 direction, is a heat receiving surface receiving the heat from the heater 56. The flow path structure 51 is placed on the first surface F1 via the heater 56 and the heat transfer member 57 described above. Four pressing members 59 and two heat dissipation members 60 are installed on the first surface F1. The second surface F2 faces the Z2 direction and constitutes the bottom surfaces of the recess 53*d* and the recess 53*h*.

In the example illustrated in FIGS. 7 and 8, the ink holes 53*b* and the wiring holes 53*c* are provided in the heat receiving portion 5*a*11 so as to open in the first surface F1 and the second surface F2, respectively. In addition to these, the first surface F1 of the heat receiving portion 5*a*11 is provided with a plurality of holes 53*e*, a plurality of holes 53*f*, a plurality of screw holes 53*g*, a plurality of recesses 53*m*, a plurality of screw holes 53*n*, a plurality of recesses 53*o*, and a plurality of screw holes 53*p*.

The holes 53*e* are used in positioning the head chip 54 with respect to the holder 53, and a protrusion (not illustrated) provided on the head chip 54 is inserted thereinto. The holes 53*f* are holes for inserting positioning pins used in positioning the flow path structure 51, the heater 56, and the heat transfer member 57. The screw holes 53*g* are used in screwing the heat transfer member 57. The screw holes 53*g* are used in screwing the flow path structure 51.

Each of the recesses 53*m* is a recess for installing the pressing member 59. The base portion 59*a* of the pressing member 59 is disposed in the recess 53*m*. In the example illustrated in FIG. 8, the recess 53*m* is positioned between the wiring hole 53*c* and the outer wall portion 5*b* when viewed in the Z2 direction. The plan-view shape of the recess 53*m* is a shape corresponding to the base portion 59*a*. Accordingly, positioning of the pressing member 59 with respect to the holder 53 or the like can be performed. The screw hole 53*n* is provided in the bottom surface of the recess 53*m*. Each of the screw holes 53*n* is a female screw used in screwing the pressing member 59 with respect to the holder 53.

Each of the recesses 53*o* is a recess for installing the heat dissipation member 60. The part 60*a* of the heat dissipation member 60 is disposed in the recess 53*o*. In the example illustrated in FIG. 8, the recess 53*o* is positioned between the two wiring holes 53*c* arranged in the X1 direction or the X2 direction when viewed in the Z2 direction. The plan-view shape of the recess 53*o* is a shape corresponding to the part 60*a*. Accordingly, positioning of the heat dissipation member 60 with respect to the holder 53 or the like can be performed. The screw hole 53*p* is provided in the bottom surface of the recess 53*o*. Each of the screw holes 53*p* is a female screw used in screwing the heat dissipation member 60 with respect to the holder 53. The recess 53*o* is an example of "coupling portion thermally coupled to drive circuit" and is thermally coupled to the drive circuit 54*j* via the heat dissipation member 60.

The side wall portion 5*a*12 protrudes in the Z2 direction from the heat receiving portion 5*a*11 and constitutes the side surfaces of the recess 53*d* and the recess 53*h*. The coupling portion 5*a*2 is coupled to the end of the side wall portion 5*a*12 in the Z2 direction. Here, when viewed in the direction along the Z axis, the shape of the side wall portion 5*a*12 is the shape of the heat receiving portion 5*a*11 from which the shapes of the recesses 53*d* and the recesses 53*h* are removed.

The coupling portion 5*a*2 is disposed so as to surround the holding portion 5*a*1 when viewed in the direction along the Z axis. The coupling portion 5*a*2 has a plate shape extending from the side wall portion 5*a*12 in a direction orthogonal to the Z axis and couples the side wall portion 5*a*12 and the outer wall portion 5*b* over the entire circumference. The coupling portion 5*a*2 may have a shape having a defective part or may be configured by a plurality of parts arranged at intervals in the circumferential direction.

The outer wall portion 5*b*, which constitutes the side surface of the recess 53*a* described above, has a frame shape extending in the Z1 direction over the entire circumference from the peripheral edge of the bottom portion 5*a*.

The flange portion 5*c* has a plate shape protruding outward in a direction orthogonal to the Z axis from the end of the outer wall portion 5*b* in the Z1 direction. In this manner, the outer peripheral edge of the coupling portion 5*a*2 of the bottom portion 5*a* is coupled via the outer wall portion 5*b* to the inner peripheral edge of the flange portion 5*c*. In the example illustrated in FIGS. 7 and 8, the flange portion 5*c* has a rectangular or substantially rectangular shape in a plan view. Accordingly, the holder 53 has a rectangular or substantially rectangular outer shape in a plan view. The flange portion 5*c* is provided with a plurality of holes 53*j* as well as the screw holes 53*i* and the screw holes 53*k*. The holes 53*j* are used in positioning the holder 53 with respect to the support body 41 by inserting a protrusion (not illustrated) provided on the support body 41.

1-6. Configuration of Heater

Figure 9:
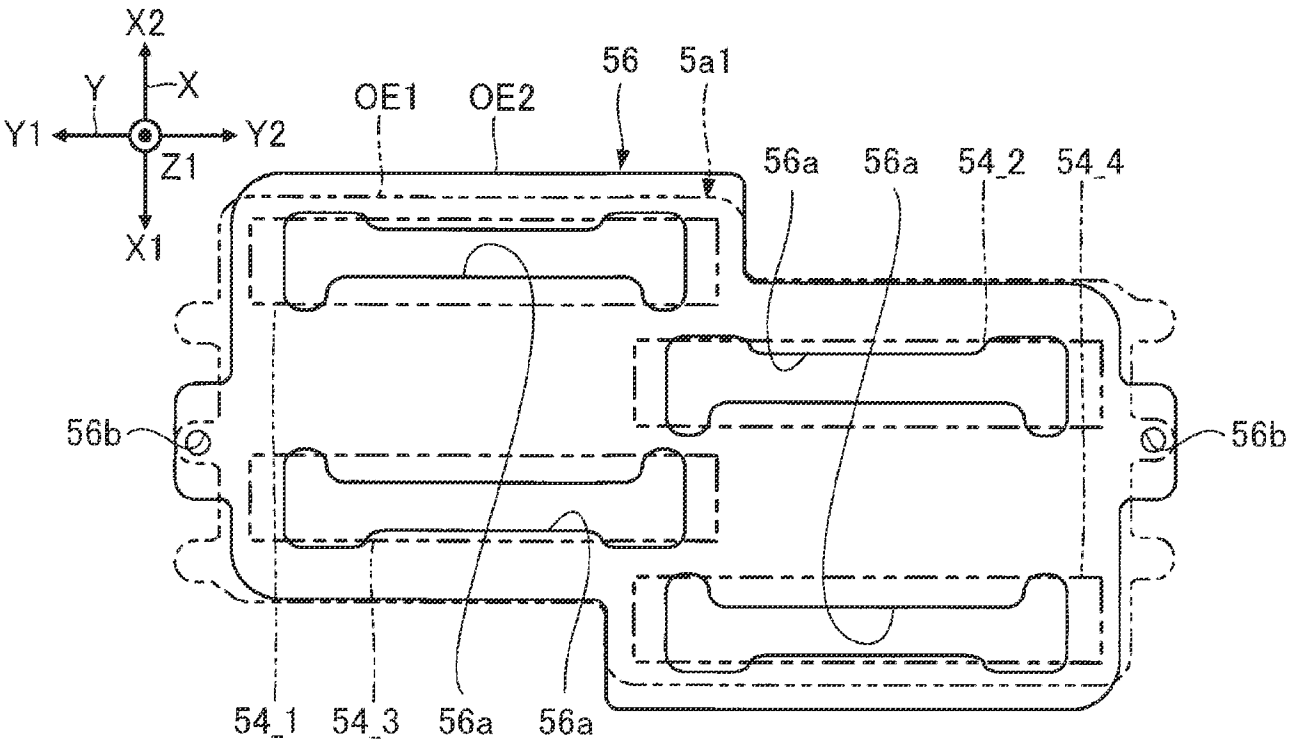
FIG. 9 is a plan view of a heater in the first embodiment.

FIG. 9 is a plan view of the heater 56 in the first embodiment. In FIG. 9, the shape of the heater 56 viewed in the Z2 direction is indicated by a solid line and the outer shapes of the holding portion 5*a*1 and the head chips 54 viewed in the Z2 direction are indicated by two-dot chain lines.

As illustrated in FIG. 9, an outer edge OE1 of the holding portion 5*a*1 has a shape corresponding to the disposition of the head chips 54_1, 54_2, 54_3, and 54_4 in a plan view in the direction along the Z axis. In other words, the outer edge OE1 in a plan view has a shape in which a pair of diagonal corners constituting the four corners of a rectangle and parts in the vicinity thereof are notched in a substantially rectangular shape.

Likewise, an outer edge OE2 of the heater 56 has a shape corresponding to the disposition of the head chips 54_1, 54_2, 54_3, and 54_4 in a plan view in the direction along the Z axis. In the present embodiment, the outer edge OE2 has substantially the same shape as the outer edge OE1 of the holding portion 5*a*1 described above. In other words, it can be said that the outer edge OE2 has a shape along the outer edge OE1.

Figure 10:
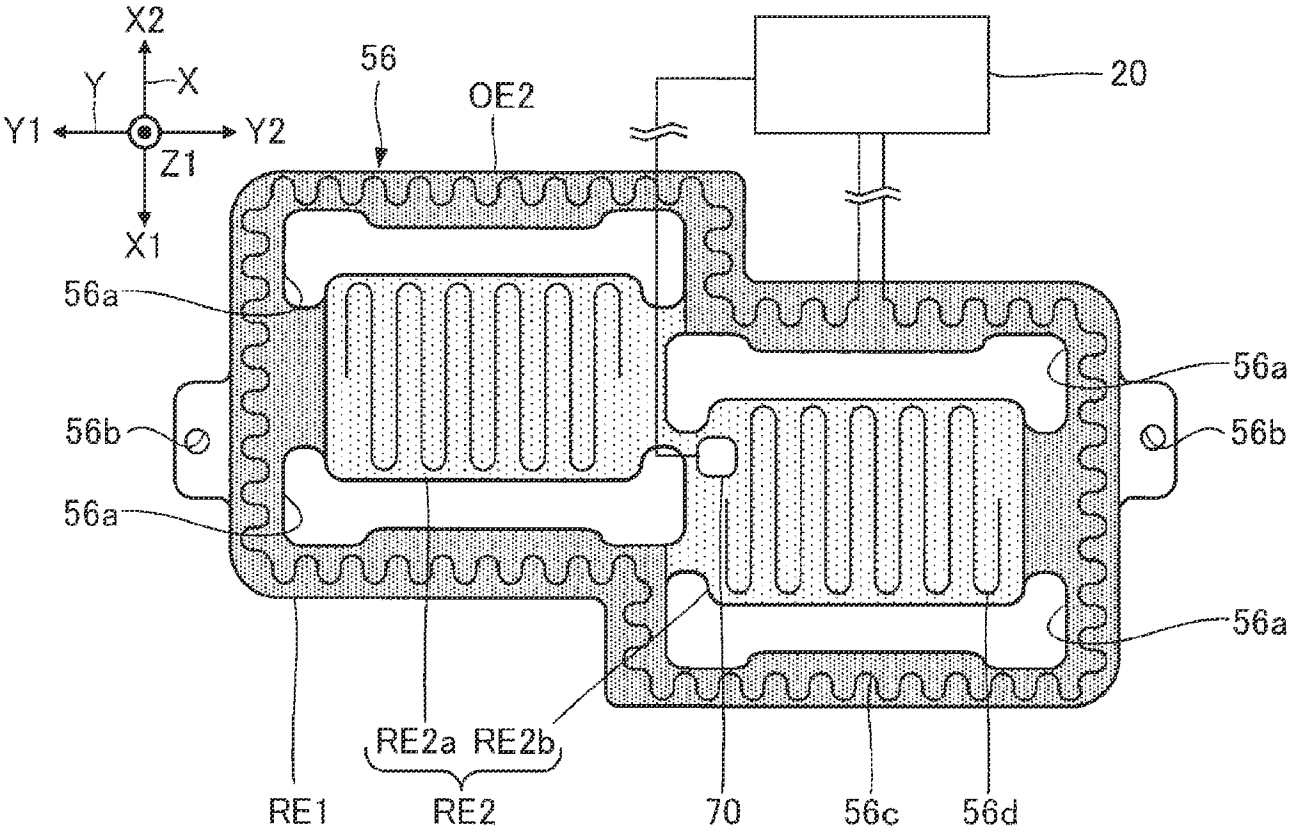
FIG. 10 is a diagram illustrating the heat generation distribution of the heater in the first embodiment.

FIG. 10 is a diagram illustrating the heat generation distribution of the heater 56 in the first embodiment. As illustrated in FIG. 10, the heater 56 includes an outer peripheral region RE1 and a middle region RE2. For convenience, the outer peripheral region RE1 and the middle region RE2 in FIG. 10 are illustrated in gray scales with different shades. In addition, FIG. 10 schematically illustrates the pattern of the heat-generating resistor that the heater 56 has.

The outer peripheral region RE1 is along an outer edge OE of the holder 53 in a plan view. In the example illustrated in FIG. 10, the outer peripheral region RE1 is a frame-shaped region surrounding the aggregate of the four holes 56*a* in a plan view. Here, the outer peripheral region RE1 has a shape along the outer periphery of the outer edge OE2 and is provided over the entire circumference along the outer edge OE2. The outer edge OE2 has substantially the same shape as the outer edge OE1 as described above, and thus it can be said that the outer peripheral region RE1 has a shape along the outer periphery of the outer edge OE1.

The outer peripheral region RE1 is provided with the heat-generating resistor 56*c*. The heat-generating resistor 56*c* is disposed over the entire circumference of the outer peripheral region RE1. In the example illustrated in FIG. 10, the heat-generating resistor 56*c* has a meander shape extending in the circumferential direction of the outer peripheral region RE1 while meandering. The shape and disposition of the heat-generating resistor 56*c* is not limited to the example illustrated in FIG. 10 and the heat-generating resistor 56*c* has any shape and any disposition insofar as heat can be substantially uniformly generated in the outer peripheral region RE1.

The heat-generating resistor 56*c* generates heat by being supplied with electric power under the control of the control unit 20 described above. In the present embodiment, the control unit 20 controls the electric power supply to the heat-generating resistor 56*c* based on the detection result of a temperature sensor 70 in the middle region RE2 such that the temperature detected by the temperature sensor 70 reaches a predetermined temperature. The temperature sensor 70 is, for example, a thermistor or a thermocouple. The disposition of the temperature sensor 70 is not limited to the example illustrated in FIG. 10. For example, the temperature sensor 70 may be provided on the head chip 54 or may be disposed on the holder 53.

The middle region RE2 is positioned inside the outer peripheral region RE1 in a plan view. In the example illustrated in FIG. 10, the middle region RE2 is configured by two first middle regions RE2*a* and RE2*b* coupled to each other. The first middle region RE2*a* is a substantially quadrangular region sandwiched between the two holes 56*a* constituting the four holes 56*a* and arranged in the direction along the X axis on the left side in FIG. 10 in a plan view. The first middle region RE2*b* is a substantially quadrangular region sandwiched between the other two holes 56*a* constituting the four holes 56*a* and arranged in the direction along the X axis on the right side in FIG. 10 in a plan view.

The middle region RE2 is provided with the heat-generating resistor 56*d*. The heat-generating resistor 56*d* is disposed over substantially the entire area of the middle region RE2. In the example illustrated in FIG. 10, the heat-generating resistor 56*d* has a meander shape extending in the direction along the Y axis while meandering. The shape and disposition of the heat-generating resistor 56*d* is not limited to the example illustrated in FIG. 10, and the heat-generating resistor 56*d* has any shape and any disposition.

In the present embodiment, the heat-generating resistor 56*d* does not generate heat because the heat-generating resistor 56*d* is not supplied with electric power and is not energized. Accordingly, the heat generation amount per unit area of the middle region RE2 is larger than the heat generation amount per unit area of the outer peripheral region RE1. As a result, the heat generation amount per unit time of the middle region RE2 is larger than the heat generation amount per unit time of the outer peripheral region RE1.

Here, the heat-generating resistor 56*d* is not electrically coupled to the heat-generating resistor 56*c* described above. In addition, although the heat-generating resistor 56*d* does not perform energization-based heat generation, the heat-generating resistor 56*d* functions as a heat transfer body transferring heat from the outer peripheral region RE1 in the plane direction. The heat-generating resistor 56*d* also functions as a spacer defining the distance between the holder 53 and the heat transfer member 57. As for the shape of the heat-generating resistor 56*d*, energization-based heat generation does not have to be taken into account, and thus the only consideration may be the function as the heat transfer body or the spacer described above.

1-7. Transfer Path of Heat from Heater

Figure 11:
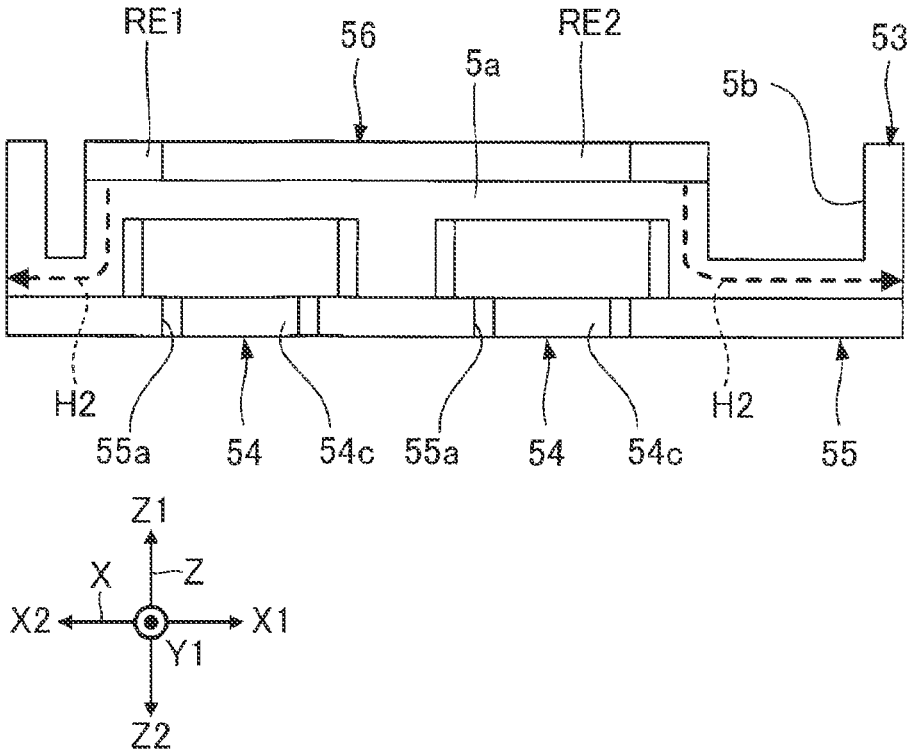
FIG. 11 is a diagram illustrating a transfer path of heat from the heater in the first embodiment.
Figure 12:
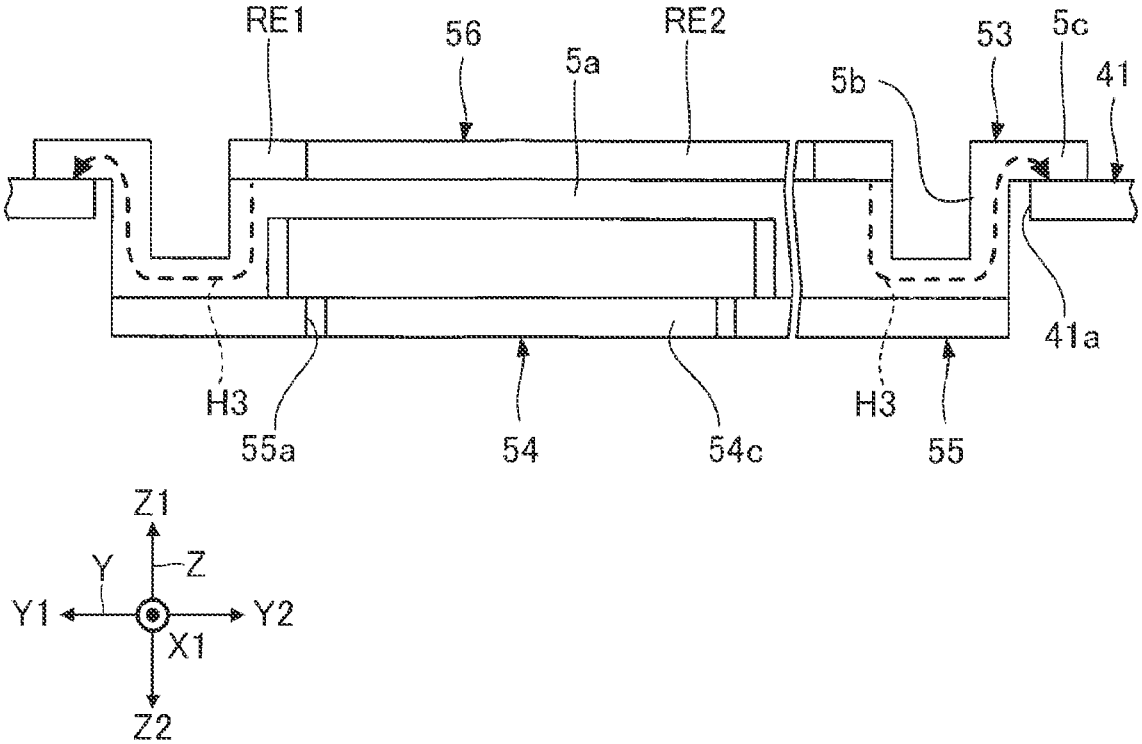
FIG. 12 is a diagram illustrating the transfer path of the heat from the heater in the first embodiment.

FIG. 11 is a diagram illustrating a transfer path H2 of the heat from the heater 56 in the first embodiment. FIG. 12 is a diagram illustrating a transfer path H3 of the heat from the heater 56 in the first embodiment. In FIGS. 11 and 12, the holder 53, the head chip 54, the fixing plate 55, and the heater 56 are schematically illustrated for convenience of description.

As described above, the holder 53 has a rectangular or substantially rectangular shape in a plan view. As illustrated in FIG. 11, the holder 53 and the support body 41 do not come into contact with each other in the lateral direction of the holder 53. Accordingly, in the lateral direction of the holder 53, some of the heat from the heater 56 is transferred to the outer wall portion 5*b* via the bottom portion 5*a* along the transfer path H2 indicated by the dashed line in FIG. 11 and is dissipated to the outside by the outer wall portion 5*b*.

As illustrated in FIG. 12, the holder 53 and the support body 41 come into contact with each other in the longitudinal direction of the holder 53. Accordingly, in the longitudinal direction of the holder 53, some of the heat from the heater 56 is not only dissipated to the outside from the outer wall portion 5*b* in the transfer path H2 described above but also transferred to the flange portion 5*c* via the bottom portion 5*a* and the outer wall portion 5*b* along the transfer path H3 indicated by the dashed line in FIG. 12 and dissipated from the flange portion 5*c* to the support body 41.

As described above, the outer peripheral portion of the holder 53 is more likely to dissipate heat than the middle portion of the holder 53. Accordingly, the heat generation amount per unit time of the outer peripheral region RE1 is larger than the heat generation amount per unit time of the middle region RE2 as described above. Accordingly, the temperature of the holder 53 can be made uniform.

As described above, the liquid ejecting head 50 includes the head chips 54, the holder 53, and the planar heater 56. Each of the head chips 54 has the nozzles N ejecting ink, which is an example of "liquid". The holder 53 holds the head chips 54. The heater 56 is disposed on the holder 53 and heats the holder 53.

Here, the heater 56 includes the outer peripheral region RE1 along the outer edge of the holder 53 and the middle region RE2 positioned inside the outer peripheral region RE1 in a plan view. The heat generation amount per unit time of the outer peripheral region RE1 is larger than the heat generation amount per unit time of the middle region RE2.

In the liquid ejecting head 50 described above, the heat generation amount per unit time of the outer peripheral region RE1 is larger than the heat generation amount per unit time of the middle region RE2, and thus the amount of heat supplied per unit time to the outer peripheral portion of the holder 53 can be increased as compared with the middle portion. Accordingly, the temperature difference between the outer peripheral portion and the middle portion of the holder 53 can be reduced even if the outer peripheral portion of the holder 53 is more likely to dissipate heat than the middle portion. As a result, the temperature difference between the head chips 54 can be reduced. In this manner, the ink of the liquid ejecting head 50 can be heated by the heater 56 with efficiency and without waste.

On the other hand, if the heat generation amount per unit time of the heater 56 is uniform, the ink at, for example, the part of the liquid ejecting head 50 where heat is easily dissipated is heated insufficiently, which leads to an increase in the possibility of poor ink ejection. In addition, in this case, overheating occurs at the part of the liquid ejecting head 50 where heat is unlikely to be dissipated or the part of the liquid ejecting head 50 that does not have to be heated, which leads to an unnecessary increase in power consumption. Further, temperature unevenness occurs in the liquid ejecting head 50 between the part where heat is easily dissipated and the part where heat is unlikely to be dissipated, and thus ink ejection characteristics also become different and a decline in printing quality arises as a result.

Examples of the part of the liquid ejecting head 50 where heat is unlikely to be dissipated include the middle portion of the liquid ejecting head 50 in a plan view and the cavity portion in the liquid ejecting head 50. Examples of the part of the liquid ejecting head 50 that does not have to be heated include the part where only the discharge flow path exists and the part where the heating target exists only on one surface of the heater 56.

As described above, in the present embodiment, the heat generation amount per unit area of the outer peripheral region RE1 is larger than the heat generation amount per unit area of the middle region RE2. Accordingly, even if the drive of the outer peripheral region RE1 and the drive of the middle region RE2 are controlled by a common control system, the heat generation amount per unit time of the outer peripheral region RE1 can be made larger than the heat generation amount per unit time of the middle region RE2. As described above, in the present embodiment, the heat-generating resistor 56*d* in the middle region RE2 is not supplied with electric power and thus does not generate heat. Here, the heat-generating resistor 56*d* functions as a heat transfer body transferring heat from the outer peripheral region RE1 in the plane direction and as a spacer defining the distance between the holder 53 and the heat transfer member 57.

In addition, as described above, the liquid ejecting head 50 includes the piezoelectric element 54*f* as an example of "drive element" and the drive circuit 54*j*. The piezoelectric element 54*f* is an element for ejecting ink from each of the nozzles N. The drive circuit 54*j* is electrically coupled to the piezoelectric element 54*f*. The drive circuit 54*j* is disposed inside the outer peripheral region RE1 in a plan view.

In such a configuration, the drive circuit 54*j* generates heat and the heat is supplied to the middle portion of the holder 53. Accordingly, if the heat generation amount per unit time of the heater 56 is uniform, the temperature of the middle portion of the holder 53 is likely to become extremely higher than the temperature of the outer peripheral portion of the holder 53. Accordingly, in such a configuration, it is particularly useful to make the heat generation amount per unit time of the outer peripheral region RE1 larger than the heat generation amount per unit time of the middle region RE2.

As described above, in the present embodiment, the holder 53 has the recess 53*o* as an example of "coupling portion". The recess 53*o* is thermally coupled to the drive circuit 54*j* and overlaps the middle region RE2 in a plan view. In such a configuration, the drive circuit 54*j* generates heat and the heat is supplied to the middle portion of the holder 53. Accordingly, if the heat generation amount per unit time of the heater 56 is uniform, the temperature of the middle portion of the holder 53 is likely to become extremely higher than the temperature of the outer peripheral portion of the holder 53. Accordingly, in such a configuration, it is particularly useful to make the heat generation amount per unit time of the outer peripheral region RE1 larger than the heat generation amount per unit time of the middle region RE2.

In addition, as described above, the holder 53 constitutes a part of the outer wall of the liquid ejecting head 50. In such a configuration, the outer peripheral portion of the holder 53 is likely to dissipate heat, and thus it is particularly useful to make the heat generation amount per unit time of the outer peripheral region RE1 larger than the heat generation amount per unit time of the middle region RE2.

As described above, the outer peripheral region RE1 surrounds the nozzles N of the head chips 54 in a plan view. Accordingly, it is possible to reduce the temperature difference between the nozzles N of each of the head chips 54.

2. SECOND EMBODIMENT

Hereinafter, a second embodiment of the present disclosure will be described. Elements in the form exemplified below that are identical in action and function to those of the first embodiment are denoted by the same reference numerals as those used in the description of the first embodiment with detailed description thereof omitted as appropriate.

Figure 13:
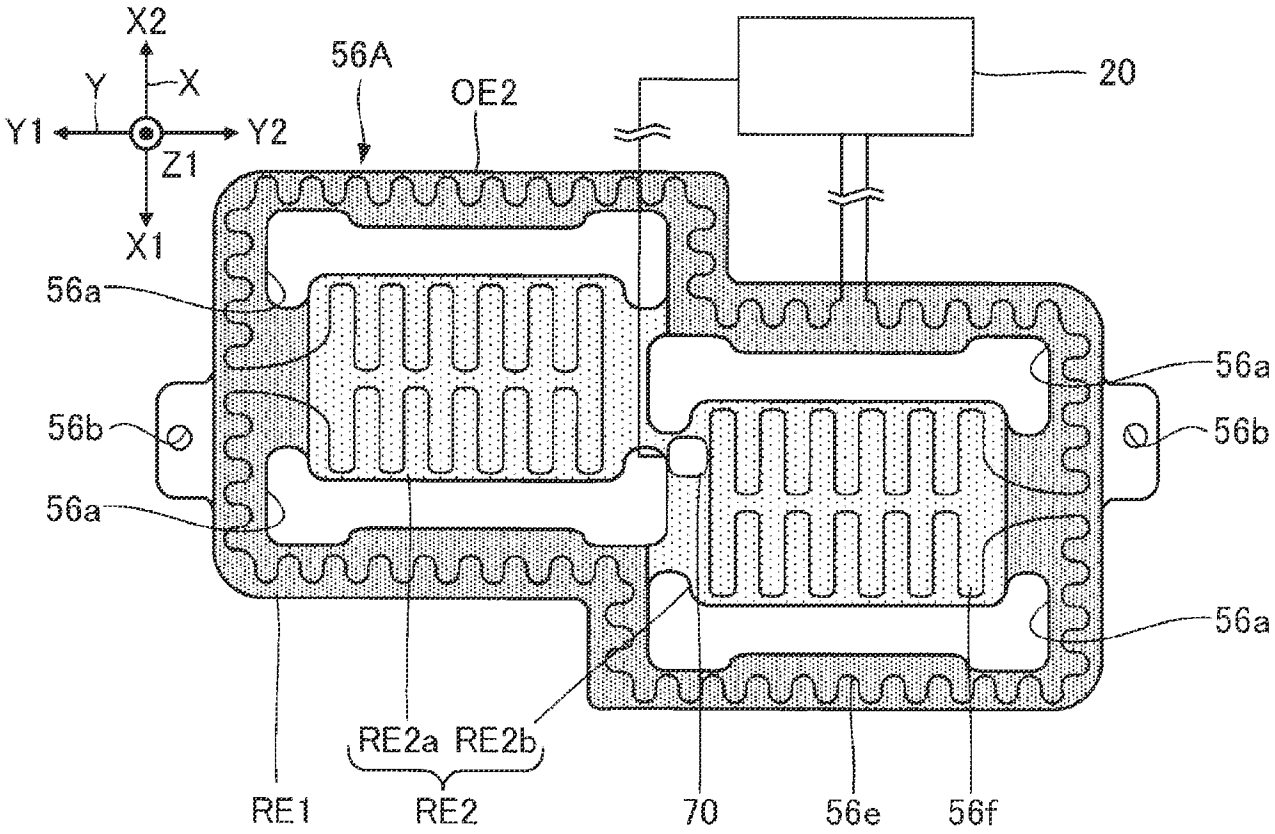
FIG. 13 is a diagram illustrating the heat generation distribution of a heater in a second embodiment.

FIG. 13 is a diagram illustrating the heat generation distribution of a heater 56A in the second embodiment. The heater 56A is identical to the heater 56 of the first embodiment except that the heater 56A has heat-generating resistors 56*e* and 56*f* instead of the heat-generating resistors 56*c* and 56*d*.

The heat-generating resistors 56*e* and 56*f* are identical to the heat-generating resistors 56*c* and 56*d* except that the heat-generating resistors 56*e* and 56*f* are electrically coupled in series to a power source (not illustrated). Here, the heat-generating resistor 56*e* is provided in the outer peripheral region RE1 and is electrically coupled to the heat-generating resistor 56*f* through the boundary portion between the outer peripheral region RE1 and the middle region RE2. The heat-generating resistor 56*f* is provided in the middle region RE2. In the example illustrated in FIG. 13, the heat-generating resistor 56*f* is divided into the first middle region RE2*a* and the first middle region RE2*b*. The heat-generating resistor 56*f* may be integrally configured over the first middle region RE2*a* and the first middle region RE2*b*.

The heat-generating resistor 56*f* is configured such that the heat generation amount per unit area of the middle region RE2 is smaller than the heat generation amount per unit area of the outer peripheral region RE1. In other words, the electric resistance of the heat-generating resistor 56*e* per unit area in the outer peripheral region RE1 is larger than the electric resistance of the heat-generating resistor 56*e* per unit area in the middle region RE2. Specifically, in this configuration, the electric resistance of the heat-generating resistor 56*e* per unit area in the outer peripheral region RE1 is larger than the electric resistance of the heat-generating resistor 56*f* per unit area in the middle region RE2 by at least one being satisfied among the cross-sectional area of the heat-generating resistor 56*e* being smaller than the cross-sectional area of the heat-generating resistor 56*f*, the length of the heat-generating resistor 56*e* per unit area in the outer peripheral region RE1 being longer than the length of the heat-generating resistor 56*f* per unit area in the middle region RE2, and the electrical resistivity of the material constituting the heat-generating resistor 56*e* being higher than the electrical resistivity of the material constituting the heat-generating resistor 56*f*. As an example, the gap between the folded and adjacent parts of the heat-generating resistor 56*e* may be made narrower than the gap between the folded and adjacent parts of the heat-generating resistor 56*f* in order to make the length of the heat-generating resistor 56*e* per unit area in the outer peripheral region RE1 longer than the length of the heat-generating resistor 56*f* per unit area in the middle region RE2. As an example, although at least one of the width and the thickness of the heat-generating resistor 56*f* needs to be larger than that of the heat-generating resistor 56*e* in order to make the cross-sectional area of the heat-generating resistor 56*f* larger than the cross-sectional area of the heat-generating resistor 56*e*, it is preferable from the viewpoint of suitably exhibiting the function of the heat-generating resistor 56*f* as a spacer that the thickness of the heat-generating resistor 56*f* is equal to the thickness of the heat-generating resistor 56*e* and the width of the heat-generating resistor 56*f* is larger than the width of the heat-generating resistor 56*e*.

In the second embodiment, the liquid of the liquid ejecting head 50 can be heated by the heater 56A with efficiency and without waste as in the first embodiment described above. The heat-generating resistors 56*e* and 56*f* may be electrically coupled in parallel to a power source (not illustrated). The heat-generating resistors 56*e* and 56*f* in this case may be opposite in configuration to those electrically coupled in series to a power source (not illustrated) and be configured such that the electric resistance of the heat-generating resistor 56*e* per unit area in the outer peripheral region RE1 is smaller than the electric resistance of the heat-generating resistor 56*e* per unit area in the middle region RE2.

3. THIRD EMBODIMENT

Hereinafter, a third embodiment of the present disclosure will be described. Elements in the form exemplified below that are identical in action and function to those of the first embodiment are denoted by the same reference numerals as those used in the description of the first embodiment with detailed description thereof omitted as appropriate.

Figure 14:
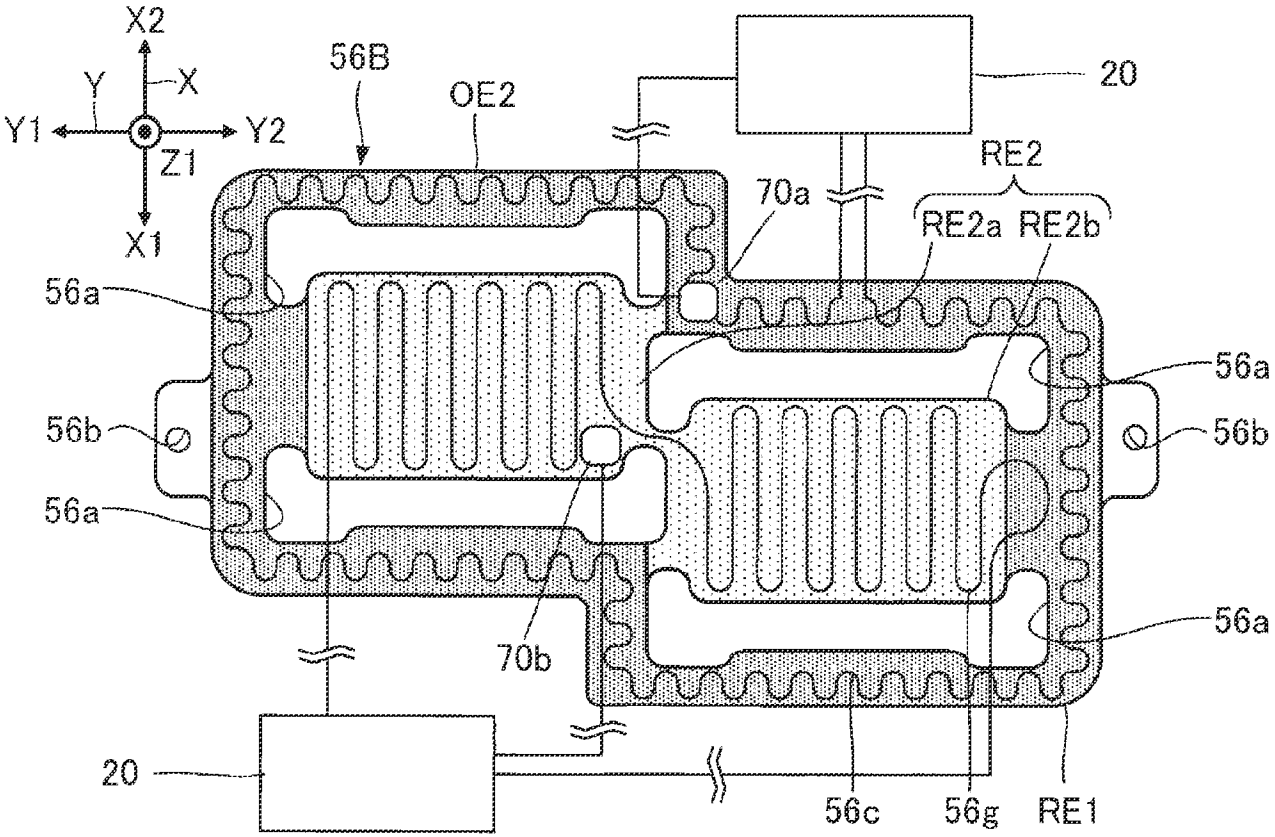
FIG. 14 is a diagram illustrating the heat generation distribution of a heater in a third embodiment.

FIG. 14 is a diagram illustrating the heat generation distribution of a heater 56B in a third embodiment. The heater 56B is identical to the heater 56 of the first embodiment described above except that the heater 56B has a heat-generating resistor 56*g* instead of the heat-generating resistor 56*d*.

The heat-generating resistor 56*g* is identical to the heat-generating resistor 56*d* except that heat is generated by energization. Here, the heat-generating resistor 56*g* is provided in the middle region RE2. In the example illustrated in FIG. 13, the heat-generating resistor 56*f* has a part provided in the first middle region RE2*a* and a part provided in the first middle region RE2*b* and these are electrically coupled in series. The heat-generating resistor 56*f* may be divided by the first middle region RE2*a* and the first middle region RE2*b*.

The heat-generating resistor 56*g* generates heat by being supplied with electric power under the control of the control unit 20 described above. In the present embodiment, the control unit 20 controls the electric power supply to the heat-generating resistor 56*g* based on the detection result of a temperature sensor 70*b* in the middle region RE2 such that the temperature detected by the temperature sensor 70*b* reaches a predetermined temperature. In addition, the control unit 20 controls the electric power supply to the heat-generating resistor 56*c* based on the detection result of a temperature sensor 70*a* in the outer peripheral region RE1 such that the temperature detected by the temperature sensor 70*a* reaches a predetermined temperature.

Here, the control unit 20 controls the electric power to the heat-generating resistors 56*c* and 56*g* such that the heat generation amount per unit time of the outer peripheral region RE1 becomes larger than the heat generation amount per unit time of the middle region RE2. In the third embodiment, the liquid of the liquid ejecting head 50 can be heated by the heater 56B with efficiency and without waste as in the first embodiment described above.

4. FOURTH EMBODIMENT

Hereinafter, a fourth embodiment of the present disclosure will be described. Elements in the form exemplified below that are identical in action and function to those of the first embodiment are denoted by the same reference numerals as those used in the description of the first embodiment with detailed description thereof omitted as appropriate.

Figure 15:
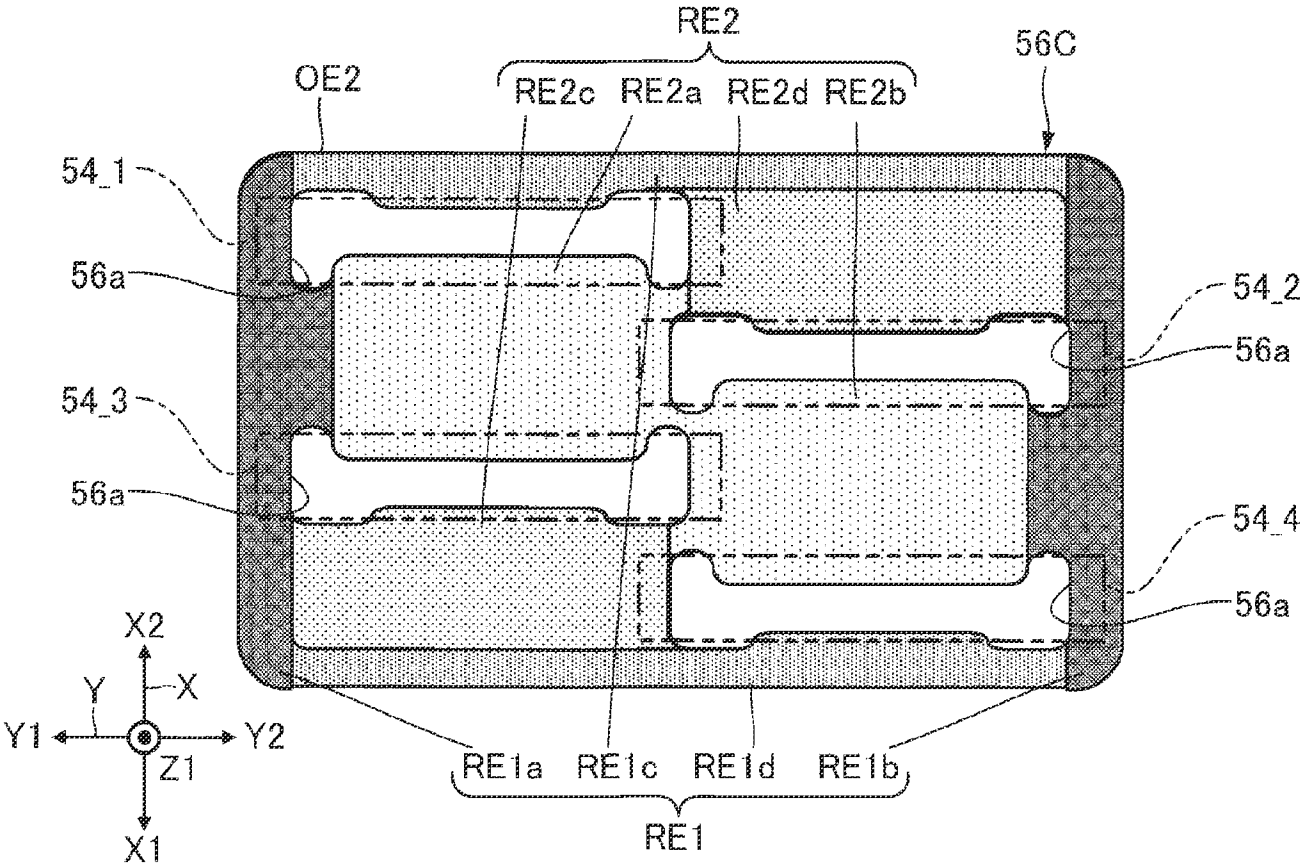
FIG. 15 is a diagram illustrating the heat generation distribution of a heater in a fourth embodiment.

FIG. 15 is a diagram illustrating the heat generation distribution of a heater 56C in the fourth embodiment. The heater 56C is identical to the heater 56 of the first embodiment except that the shape in a plan view and the distribution of the heat generation amount per unit time are different.

As illustrated in FIG. 15, the heater 56C forms a substantially quadrangular shape in a plan view. In the heater 56C, the outer peripheral region RE1 includes first outer peripheral regions RE1*a* and RE1*b* and second outer peripheral regions RE1*c* and RE1*d*.

The first outer peripheral regions RE1*a* and RE1*b* are the parts of the outer peripheral region RE1 that are along the two short sides of the outer edge OE2. The second outer peripheral regions RE1*c* and RE1*d* are the parts of the outer peripheral region RE1 that are along the two long sides of the outer edge OE2. Here, the heat generation amount per unit time of each of the first outer peripheral regions RE1*a* and RE1*b* is larger than the heat generation amount per unit time of each of the second outer peripheral regions RE1*c* and RE1*d*. Such a heat generation amount relationship is realized by, for example, adjusting the electric resistance per unit area of the heat-generating resistor as in the second embodiment described above.

In addition, in the heater 56C, the middle region RE2 includes the first middle regions RE2*a* and RE2*b* and second middle regions RE2*c* and RE2*d*. The second middle region RE2*c* is between the first middle region RE2*a* and the outer peripheral region RE1. The second middle region RE2*d* is between the first middle region RE2*b* and the outer peripheral region RE1. Here, the heat generation amount per unit time of each of the second middle regions RE2*c* and RE2*d* is larger than the heat generation amount per unit time of each of the first middle regions RE2*a* and RE2*b*. Such a heat generation amount relationship is realized by, for example, adjusting the electric resistance per unit area of the heat-generating resistor as in the second embodiment described above.

In the fourth embodiment, the liquid of the liquid ejecting head 50 can be heated by the heater 56C with efficiency and without waste as in the first embodiment described above. Here, as described above, the liquid ejecting head 50 includes the flange portion 5*c*. The flange portion 5*c* comes into contact with the support body 41 supporting the liquid ejecting head 50 and protrudes in the Y1 and Y2 directions, which are examples of "first direction", with respect to the heater 56C in a plan view. As described above, in the present embodiment, the outer peripheral region RE1 includes the first outer peripheral regions RE1*a* and RE1*b* and the second outer peripheral regions RE1*c* and RE1*d*. The first outer peripheral regions RE1*a* and RE1*b* are positioned in the Y1 direction or the Y2 direction with respect to the middle region RE2 in a plan view. The second outer peripheral regions RE1*c* and RE1*d* are positioned in the X1 direction or the X2 direction, which is an example of "second direction orthogonal to the first direction", with respect to the middle region RE2 in a plan view.

The heat generation amount per unit time of the first outer peripheral regions RE1*a* and RE1*b* is larger than the heat generation amount per unit area of the second outer peripheral regions RE1*c* and RE1*d*. Accordingly, the amount of heat supplied per unit time to the part of the holder 53 close to the flange portion 5*c* can be increased as compared with the amount of heat supplied per unit time to the part of the holder 53 far from the flange portion 5*c*. Accordingly, the holder 53 can be uniformly heated even if the part of the holder 53 close to the flange portion 5*c* is more likely to dissipate heat than the part of the holder 53 far from the flange portion 5*c*.

Here, the flange portion 5*c* is a part of the holder 53 as described above. Accordingly, the part of the holder 53 close to the flange portion 5*c* is more likely to dissipate heat than the part of the holder 53 far from the flange portion 5*c* as compared with a configuration in which the flange portion 5*c* is separate from the holder 53.

In addition, as described above, the middle region RE2 includes the first middle regions RE2*a* and RE2*b* disposed between two of the head chips 54 adjacent to each other and the second middle regions RE2*c* and RE2*d* different from the first middle regions RE2*a* and RE2*b* in a plan view. The heat generation amount per unit time of the second middle regions RE2*c* and RE2*d* is larger than the heat generation amount per unit time of the first middle regions RE2*a* and RE2*b*. Accordingly, the temperature difference between the head chips 54 can be reduced as compared with a configuration in which the heat generation amount per unit time of the second middle regions RE2*c* and RE2*d* is equal to or less than the heat generation amount per unit time of the first middle regions RE2*a* and RE2*b*.

5. MODIFICATION EXAMPLES

The forms exemplified above can be variously modified. Exemplified below are specific aspects of modification applicable to the forms described above. Any two or more aspects selected from the following examples can be appropriately merged to the extent that the aspects are not mutually contradictory.

5-1. Modification Example 1

Figure 16:
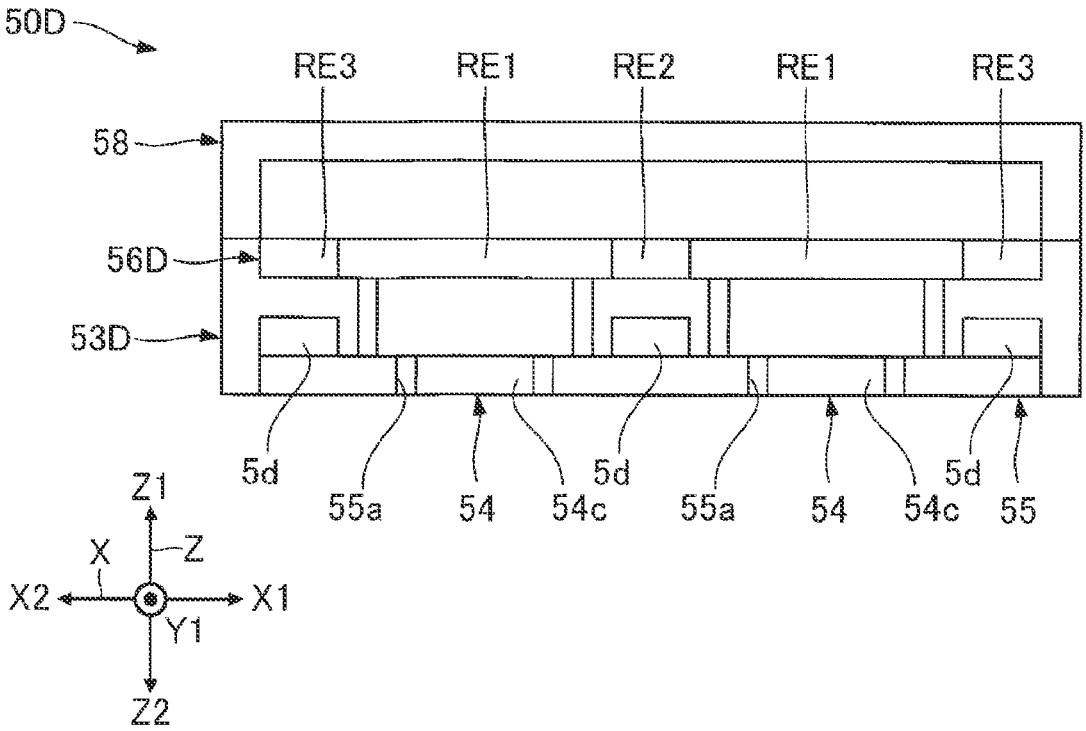
FIG. 16 is a schematic view of a liquid ejecting head according to Modification Example 1.

FIG. 16 is a schematic view of a liquid ejecting head 50D according to Modification Example 1. The liquid ejecting head 50D is identical to the liquid ejecting head 50 of the first embodiment except that the liquid ejecting head 50D has a holder 53D and a heater 56D instead of the holder 53 and the heater 56.

A space 5*d* is provided between the holder 53D and the fixing plate 55. The space 5*d* is configured by air, and thus heat transfer is unlikely to occur. In this regard, the heater 56D is provided with a second region RE2 and a third region RE3, which are smaller than a first region RE1 in heat generation amount per unit time, at positions overlapping the space 5*d* in a plan view. Here, the third region RE3 is positioned closer to the outer periphery of the holder 53D than the first region RE1. The third region RE3 may be provided at a position closer to the outer periphery of the holder 53D than the first region RE1 as described above, and the first region RE1 may not be the position closest to the outer periphery of the heater 56D.

5-2. Modification Example 2

Figure 17:
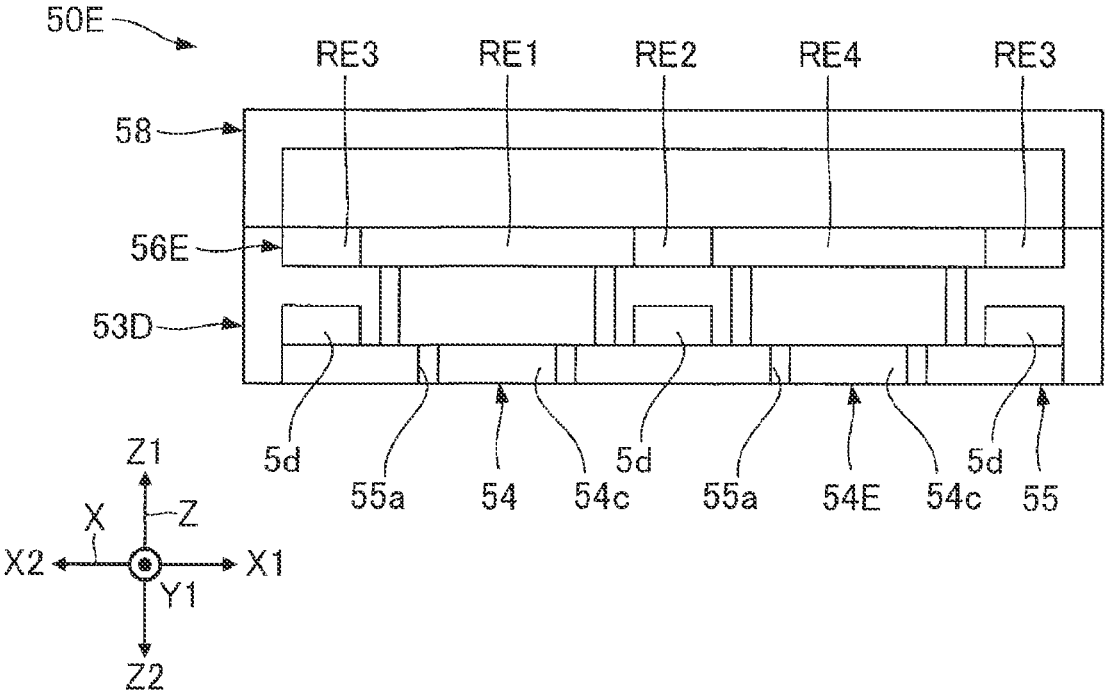
FIG. 17 is a schematic view of a liquid ejecting head according to Modification Example 2.

FIG. 17 is a schematic view of a liquid ejecting head 50E according to Modification Example 2. The liquid ejecting head 50E is identical to the liquid ejecting head 50 of the first embodiment except that the liquid ejecting head 50E has a head chip 54E instead of at least one of the head chips 54 and has the holder 53D and a heater 56E instead of the holder 53 and the heater 56.

The heat capacity of the head chip 54E is smaller than the heat capacity of the head chip 54. Accordingly, the head chip 54E is more likely to become warm than the head chip 54. In other words, the head chip 54 is less likely to become warm than the head chip 54E. In this regard, the heater 56E is provided with a fourth region RE4, which is smaller than the first region RE1 in heat generation amount per unit time, at a position overlapping the head chip 54E in a plan view. Here, the heat generation amount per unit time of the fourth region RE4 is larger than the heat generation amount per unit time of each of the second region RE2 and the third region RE3.

5-3. Modification Example 3

Figure 18:
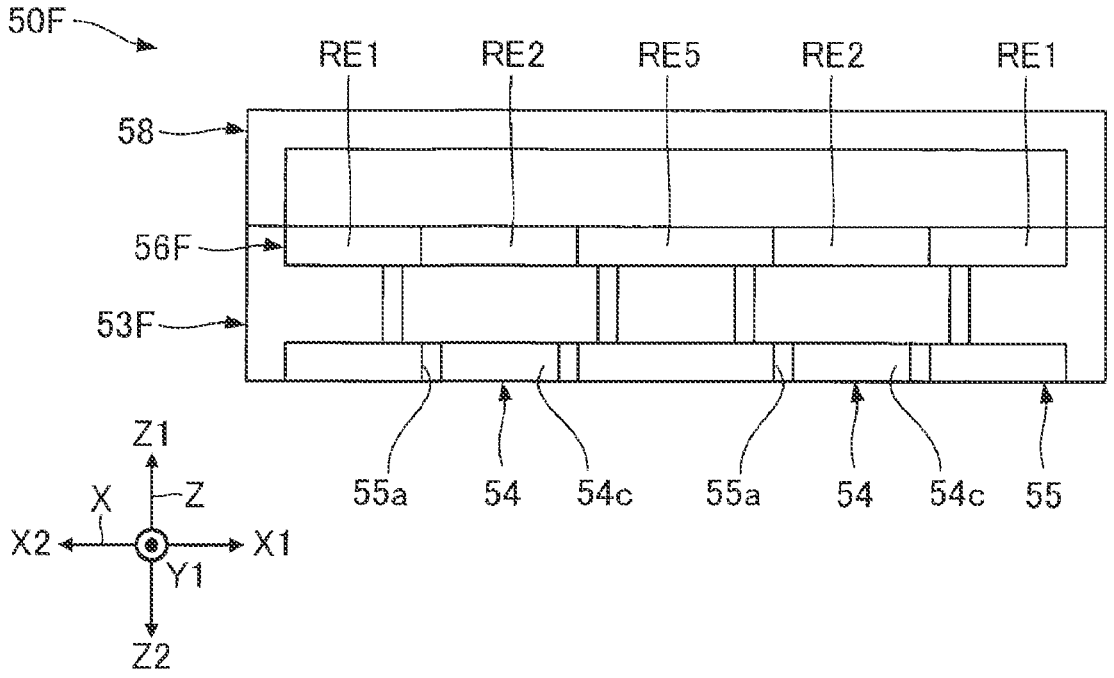
FIG. 18 is a schematic view of a liquid ejecting head according to Modification Example 3.

FIG. 18 is a schematic view of a liquid ejecting head 50F according to Modification Example 3. The liquid ejecting head 50F is identical to the liquid ejecting head 50 of the first embodiment except that the liquid ejecting head 50F has a holder 53F and a heater 56F instead of the holder 53 and the heater 56. The holder 53F is identical to the holder 53D except that the space 5*d* is omitted.

In Modification Example 3, the thermal emissivity of the fixing plate 55 is higher than the thermal emissivity of the nozzle plate 54*c*. Accordingly, the part of the aggregate of the holder 53F and the head chip 54 that overlaps the fixing plate 55 in a plan view is likely to dissipate heat. In this regard, the heater 56F is provided with the first region RE1 and a fifth region RE5, which are larger than the second region RE2 in heat generation amount per unit time, at positions overlapping the fixing plate 55 in a plan view. Here, the fifth region RE5 is positioned inside the second region RE2. The fifth region RE5 may be provided inside the second region RE2 as described above, and the second region RE2 may not be positioned on the innermost side of the heater 56D. In addition, the heat generation amount per unit time of the fifth region RE5 may be equal to or different from the heat generation amount per unit time of the first region RE1.

5-4. Modification Example 4

In the form described above, the plan-view shape of the holding portion 5*a*1 is non-rectangular in accordance with the disposition of the four head chips 54. The plan-view shape of the holding portion 5*a*1 is not limited to the above form. For example, the shape may be a rectangular or substantially rectangular shape.

5-5. Modification Example 5

In the form described above, the plan-view shape of the heater 56 is non-rectangular in accordance with the disposition of the four head chips 54. The plan-view shape of the heater 56 is not limited to the above form. For example, the shape may be a rectangular or substantially rectangular shape.

5-6. Modification Example 6

In the form described above, a configuration using one heat transfer member 57 is exemplified. However, the present disclosure is not limited thereto. For example, the heat transfer member 57 may be omitted.

5-7. Modification Example 7

Exemplified in the above form is a configuration in which the liquid ejecting head 50 has four head chips 54. However, the present disclosure is not limited thereto, and the number may be two, three, or five or more. In the above form, the head chips 54 are staggered along the longitudinal direction of the head chips 54. However, the present disclosure is not limited thereto. The head chips 54 may be staggered along the lateral direction of the head chips 54.

5-8. Modification Example 8

Although the serial liquid ejecting apparatus 100 in which the support body 41 supporting the liquid ejecting head 50 reciprocates is exemplified in the above form, the present disclosure is also applicable to a line-type liquid ejecting apparatus in which the nozzles N are distributed over the entire width of the medium M. In other words, the support body supporting the liquid ejecting head 50 is not limited to a serial carriage and may be a structure supporting the liquid ejecting head 50 in a line-type liquid ejecting apparatus. In this case, a plurality of the liquid ejecting heads 50 are, for example, disposed side by side in the width direction of the medium M and the liquid ejecting heads 50 are collectively supported by one support body.

5-9. Modification Example 9

The liquid ejecting apparatus exemplified in the above form can be adopted in various types of equipment such as a facsimile machine and a copier as well as dedicated printing equipment. However, the use of the liquid ejecting apparatus is not limited to printing. For example, a liquid ejecting apparatus that ejects a solution of a coloring material is used as a manufacturing apparatus for forming a color filter of a display device such as a liquid crystal display panel. In addition, a liquid ejecting apparatus that ejects a solution of a conductive material is used as a manufacturing apparatus for forming an electrode and wiring of a wiring substrate. In addition, a liquid ejecting apparatus that ejects a solution of a living body-related organic substance is used as, for example, a biochip manufacturing apparatus.

What is claimed is:

1. A liquid ejecting head comprising:

a plurality of head chips respectively having nozzles configured to eject a liquid;

a holder holding the plurality of head chips; and a planar heater disposed on the holder and heating the holder, wherein the heater includes an outer peripheral region along an outer edge of the holder and a middle region positioned inside the outer peripheral region in a plan view, and a heat generation amount per unit time of the outer peripheral region is larger than a heat generation amount per unit time of the middle region.

2. The liquid ejecting head according to claim 1, wherein a heat generation amount per unit area of the outer peripheral region is larger than a heat generation amount per unit area of the middle region.

3. The liquid ejecting head according to claim 1, further comprising a flange portion coming into contact with a support body supporting the liquid ejecting head and protruding in a first direction with respect to the heater in a plan view, wherein the outer peripheral region includes a first outer peripheral region positioned in the first direction with respect to the middle region in a plan view and a second outer peripheral region positioned in a second direction orthogonal to the first direction with respect to the middle region in a plan view, and a heat generation amount per unit time of the first outer peripheral region is larger than a heat generation amount per unit area of the second outer peripheral region.

4. The liquid ejecting head according to claim 3, wherein the flange portion is a part of the holder.

5. The liquid ejecting head according to claim 1, further comprising:

drive elements for ejecting a liquid from each of the nozzles; and a drive circuit electrically coupled to the drive elements, wherein the drive circuit is disposed inside the outer peripheral region in a plan view.

6. The liquid ejecting head according to claim 5, wherein the holder has a coupling portion thermally coupled to the drive circuit, and the coupling portion overlaps the middle region in a plan view.

7. The liquid ejecting head according to claim 1, wherein the holder constitutes a part of an outer wall of the liquid ejecting head.

8. The liquid ejecting head according to claim 1, wherein the outer peripheral region surrounds the nozzles of the plurality of head chips in a plan view.

9. The liquid ejecting head according to claim 1, wherein the middle region includes a first middle region disposed between two of the plurality of head chips adjacent to each other in a plan view and a second middle region different from the first middle region in a plan view, and a heat generation amount per unit time of the second middle region is larger than a heat generation amount per unit time of the first middle region.

10. The liquid ejecting head according to claim 1, wherein the heater has a heat-generating resistor provided in the middle region and a heat-generating resistor provided in the outer peripheral region, the heat-generating resistor provided in the middle region is not energized, and the heat-generating resistor provided in the middle region is equal in thickness to the heat-generating resistor provided in the outer peripheral region.

11. A liquid ejecting apparatus comprising:

the liquid ejecting head according to claim 1; and a control portion controlling drive of the heater.

12. The liquid ejecting apparatus according to claim 11, further comprising a support body supporting the liquid ejecting head and made of a metal material.

* * * * *